US010598176B2

(12) United States Patent
Afshari

(10) Patent No.: US 10,598,176 B2
(45) Date of Patent: Mar. 24, 2020

(54) EXTERNAL GEAR PUMP INTEGRATED WITH TWO INDEPENDENTLY DRIVEN PRIME MOVERS

(71) Applicant: Project Phoenix, LLC, Mesa, AZ (US)

(72) Inventor: Thomas Afshari, Phoenix, AZ (US)

(73) Assignee: Project Phoenix, LLC, Mesa, AZ (US)

( * ) Notice: Subject to any disclaimer, the term of this patent is extended or adjusted under 35 U.S.C. 154(b) by 176 days.

(21) Appl. No.: 15/327,748

(22) PCT Filed: Jul. 22, 2015

(86) PCT No.: PCT/US2015/041612

§ 371 (c)(1),
(2) Date: Jan. 20, 2017

(87) PCT Pub. No.: WO2016/014715

PCT Pub. Date: Jan. 28, 2016

(65) Prior Publication Data

US 2017/0204854 A1 Jul. 20, 2017

Related U.S. Application Data

(60) Provisional application No. 62/066,198, filed on Oct. 20, 2014, provisional application No. 62/060,431,
(Continued)

(51) Int. Cl.
*F04C 15/00* (2006.01)
*F04C 15/06* (2006.01)
(Continued)

(52) U.S. Cl.
CPC ..... *F04C 2/08* (2013.01); *F04C 2/084* (2013.01); *F04C 2/086* (2013.01); *F04C 2/16* (2013.01);
(Continued)

(58) Field of Classification Search
CPC .. F04C 11/008; F04C 15/008; F04C 15/0096; F04C 15/06; F04C 2230/603;
(Continued)

(56) References Cited

U.S. PATENT DOCUMENTS 337,551 A 3/1886 Berrenberg et al.
688,616 A 12/1901 Ferguson
(Continued)

FOREIGN PATENT DOCUMENTS

CA 2236535 A1 11/1999
CH 625 600 A5 9/1981
(Continued)

OTHER PUBLICATIONS

Supplemental European Search Report, European Application No. EP 18 20 7568.9 (not yet published), 7 pages (dated Feb. 4, 2019).
(Continued)

*Primary Examiner* — Dominick L Plakkoottam
(74) *Attorney, Agent, or Firm* — Perkins Coie LLP

(57) ABSTRACT

A pump includes a casing defining an interior volume. The pump casing includes at least one balancing plate that can be part of a wall of the pump casing with each balancing plate including a protruding portion having two recesses. Each recess is configured to accept one end of a fluid driver. The balancing plate aligns the fluid displacement members with respect to each other such that the fluid displacement members can pump the fluid when rotated. The balancing plates can include cooling grooves connecting the respective recesses. The cooling grooves ensure that some of the liquid being transferred in the internal volume is directed to bearings disposed in the recesses as the fluid drivers rotate.

12 Claims, 16 Drawing Sheets

Related U.S. Application Data filed on Oct. 6, 2014, provisional application No. 62/027,330, filed on Jul. 22, 2014.

(51) Int. Cl.

| | |
|---|---|
| ***F04C 11/00*** | (2006.01) |
| ***F04C 2/18*** | (2006.01) |
| ***F04C 2/08*** | (2006.01) |
| ***F04C 2/16*** | (2006.01) |
| *F04C 29/04* | (2006.01) |
| *F04C 29/02* | (2006.01) |

(52) U.S. Cl.

CPC ..... *F04C 2/18* (2013.01); *F04C 11/008* (2013.01); *F04C 15/008* (2013.01); *F04C 15/0096* (2013.01); *F04C 15/06* (2013.01); *F04C 29/028* (2013.01); *F04C 29/045* (2013.01); *F04C 2230/603* (2013.01); *F04C 2240/30* (2013.01); *F04C 2240/40* (2013.01); *F04C 2240/60* (2013.01); *F04C 2240/603* (2013.01)

(58) Field of Classification Search

CPC .. F04C 2240/30; F04C 2240/40; F04C 2/084; F04C 2/18; F04C 2240/402; F04C 2/08; F04C 2/102

USPC ..... 417/212, 410.4, 354

See application file for complete search history.

(56) References Cited

U.S. PATENT DOCUMENTS 1,341,846 A 6/1920 Gollings
1,361,423 A 12/1920 Waterous
1,407,496 A 2/1922 Storey
1,418,741 A 6/1922 Stallman
1,665,120 A 4/1928 Wendell
1,681,796 A 8/1928 Wendell
1,712,157 A 5/1929 Morita
2,439,427 A 4/1948 Guibert et al.
2,572,334 A 10/1951 Guibert
2,601,397 A 6/1952 Hill et al.
2,621,603 A 12/1952 Thomas
2,918,209 A 12/1959 Schueller
2,928,295 A 3/1960 Boulanger
2,937,807 A 5/1960 Lorenz
2,940,661 A 6/1960 Lorenz
3,136,224 A 6/1964 Escobosa
3,264,502 A 8/1966 Lytle et al.
3,585,973 A 6/1971 Klover
3,694,105 A 9/1972 Martin
3,763,746 A 10/1973 Walters
3,922,855 A 12/1975 Bridwell et al.
3,932,993 A 1/1976 Riedhammer
3,979,910 A 9/1976 Leuenberger et al.
4,016,719 A 4/1977 Yavnai
4,030,403 A 6/1977 Elser
4,345,436 A 8/1982 Johnson
4,369,625 A 1/1983 Izumi et al.
4,418,610 A 12/1983 Holtrop
4,529,362 A 7/1985 Ichiryu et al.
4,627,237 A 12/1986 Hutson
4,630,441 A 12/1986 Chamberlain
4,682,939 A 7/1987 Petro
4,850,812 A 7/1989 Voight
5,026,248 A 6/1991 Hamilton
5,048,294 A 9/1991 Oshina et al.
5,197,861 A 3/1993 Maruyama et al.
5,271,719 A 12/1993 Abe et al.
5,295,798 A 3/1994 Maruyama et al.
5,329,216 A 7/1994 Hasegawa
5,708,311 A 1/1998 Claar et al.
5,709,537 A 1/1998 Maruyama et al.
5,767,635 A 6/1998 Steffens et al.
5,778,671 A 7/1998 Bloomquist et al.
5,836,746 A * 11/1998 Maruyama ..... F04C 29/0085 417/44.1
6,002,186 A 12/1999 Coutu et al.
6,042,095 A 3/2000 Kuchta
6,048,235 A 4/2000 Kai
6,053,717 A 4/2000 Dixon
6,155,790 A 12/2000 Pyötsiä et al.
6,247,906 B1 6/2001 Pijanowski
6,447,256 B2 9/2002 Bussard
6,447,266 B2 9/2002 Antaki et al.
6,543,223 B2 4/2003 Muschong et al.
6,652,249 B2 11/2003 Kenney et al.
6,796,120 B2 9/2004 Franchet et al.
6,971,463 B2 12/2005 Shore et al.
6,979,185 B2 12/2005 Kaempe
7,000,386 B1 2/2006 Morgan
7,051,526 B2 5/2006 Geiger
7,155,910 B2 1/2007 Last
7,191,593 B1 3/2007 Ho
7,232,292 B2 6/2007 Lopatinsky et al.
7,240,893 B2 6/2007 Komaba et al.
7,434,395 B2 10/2008 He
7,870,727 B2 1/2011 Mueller et al.
7,927,079 B2 4/2011 Suzuki et al.
8,157,539 B2 4/2012 Hidaka et al.
8,167,589 B2 5/2012 Hidaka et al.
8,448,432 B2 5/2013 Bresie
8,869,924 B2 10/2014 Kim
8,959,905 B2 2/2015 Baltes et al.
2002/0009368 A1 1/2002 Bussard
2003/0077183 A1 4/2003 Franchet et al.
2003/0126981 A1 7/2003 Bridger et al.
2003/0151315 A1 8/2003 Choi et al.
2004/0060430 A1 4/2004 Brinkman
2004/0213680 A1 10/2004 Suzuki et al.
2005/0022523 A1 2/2005 Nagai et al.
2005/0089414 A1 4/2005 Ohman
2005/0144939 A1 7/2005 Mentink et al.
2005/0238505 A1* 10/2005 Iwasaki ..... F04C 2/086 417/410.4
2005/0254970 A1* 11/2005 Mayer ..... F04C 2/086 417/410.4
2006/0001202 A1 1/2006 Bauman
2006/0039804 A1 2/2006 Jordan et al.
2006/0156713 A1 7/2006 Kadlicko
2007/0074511 A1 4/2007 Verkuilen
2007/0098576 A1* 5/2007 Horng ..... F04C 2/18 417/420
2007/0101711 A1 5/2007 Debus
2007/0157612 A1 7/2007 He
2007/0166168 A1 7/2007 Vigholm
2008/0010984 A1 1/2008 Arbel et al.
2008/0190104 A1 8/2008 Bresie
2009/0210120 A1 8/2009 Stein
2009/0266934 A1 10/2009 Makino
2010/0247362 A1 9/2010 Koizumi
2010/0264885 A1 10/2010 Olsen et al.
2010/0322805 A1 12/2010 Aregger
2011/0000203 A1 1/2011 Riedel et al.
2011/0017310 A1 1/2011 Eriksson
2011/0030364 A1 2/2011 Persson et al.
2011/0030505 A1 2/2011 Hoyle et al.
2011/0135516 A1 6/2011 Oishi et al.
2011/0250082 A1 10/2011 Han et al.
2012/0141315 A1* 6/2012 Seto ..... F04C 2/086 418/142
2012/0173027 A1 7/2012 Cheng et al.
2012/0233997 A1 9/2012 Andruch, III et al.
2012/0305603 A1* 12/2012 Kwok ..... F04C 2/084 222/251
2013/0074487 A1 3/2013 Herold et al.
2013/0091833 A1 4/2013 Zhan
2013/0098015 A1 4/2013 Opdenbosh
2013/0098017 A1 4/2013 Knussman et al.
2013/0098464 A1 4/2013 Knussman
2013/0239558 A1 9/2013 Shirao
2013/0298542 A1 11/2013 Lowman et al.
2014/0105714 A1 4/2014 Kim

(56) References Cited

U.S. PATENT DOCUMENTS

| | | | |
|---|---|---|---|
| 2014/0130487 | A1 | 5/2014 | Akiyama |
| 2014/0174549 | A1 | 6/2014 | Dybing |
| 2014/0308106 | A1 | 10/2014 | Beschorner |
| 2014/0366519 | A1 | 12/2014 | Sadamori |
| 2015/0121860 | A1 | 5/2015 | Hyon |
| 2015/0275927 | A1 | 10/2015 | Gomm et al. |
| 2015/0308463 | A1 | 10/2015 | Gomm et al. |
| 2016/0084274 | A1 | 3/2016 | Afshari |
| 2016/0138588 | A1 | 5/2016 | Afshari |
| 2017/0045046 | A1 | 2/2017 | Afshari |
| 2017/0097019 | A1 | 4/2017 | Afshari |
| 2017/0114807 | A1 | 4/2017 | Afshari |
| 2017/0114893 | A1 | 4/2017 | Afshari |
| 2017/0146035 | A1 | 5/2017 | Afshari |
| 2017/0204854 | A1 | 7/2017 | Afshari |
| 2017/0314674 | A1 | 11/2017 | Afshari |
| 2018/0172003 | A1 | 6/2018 | Afshari |
| 2018/0252213 | A1 | 9/2018 | Afshari |
| 2018/0291895 | A1 | 10/2018 | Afshari |

FOREIGN PATENT DOCUMENTS

| | | | |
|---|---|---|---|
| CN | 101655087 | A | 2/2018 |
| DE | 1 258 617 | | 1/1968 |
| DE | 1 528 965 | | 10/1969 |
| DE | 3 230 550 | A1 | 1/1984 |
| DE | 3 247 004 | A1 | 6/1984 |
| DE | 3 821 321 | A1 | 12/1989 |
| DE | 10 2008 018407 | A1 | 10/2009 |
| DE | 10 2009 027282 | A1 | 12/2010 |
| DE | 10 2009 028095 | A1 | 2/2011 |
| DE | 10 2009 045028 | A1 | 3/2011 |
| DE | 10 2011 005831 | A1 | 9/2012 |
| DE | 10 2012 102156 | A1 | 10/2012 |
| EP | 0 558 921 | A1 | 9/1993 |
| EP | 0 942 173 | A1 | 9/1999 |
| EP | 1 249 608 | A1 | 10/2002 |
| EP | 1 531 269 | | 5/2005 |
| EP | 1 967 745 | A1 | 9/2008 |
| EP | 2 113 666 | A2 | 11/2009 |
| EP | 2 816 237 | A1 | 12/2014 |
| FR | 2.119.294 | | 8/1972 |
| FR | 2 428 771 | | 1/1980 |
| GB | 270 000 | | 5/1927 |
| GB | 1 081 711 | A | 8/1967 |
| GB | 1 284 551 | | 8/1972 |
| GB | 1 284 552 | | 8/1972 |
| GB | 1 284 553 | | 8/1972 |
| GB | 1 450 436 | | 9/1976 |
| GB | 2 123 089 | A | 1/1984 |
| GB | 2 259 333 | | 3/1993 |
| JP | S59-20590 | A | 2/1984 |
| JP | 2001-011899 | A | 1/2001 |
| JP | 2001-153066 | A | 6/2001 |
| JP | 2002-147370 | A | 5/2002 |
| JP | 2003-088084 | A | 3/2003 |
| JP | 2006-316662 | A | 11/2006 |
| JP | 3 154 210 | U | 10/2009 |
| JP | 2014-009655 | A | 1/2014 |
| JP | 2014-512495 | A | 5/2014 |
| RU | 2284424 | C1 | 9/2006 |
| RU | 2009149035 | A | 8/2011 |
| SU | 857 550 | A | 8/1981 |
| SU | 1 087 705 | A | 4/1984 |
| WO | WO 1991/13256 | A1 | 9/1991 |
| WO | WO 01/073295 | A1 | 10/2001 |
| WO | WO 03/069160 | A1 | 8/2003 |
| WO | WO 2004/071845 | A1 | 8/2004 |
| WO | WO 2008/060681 | A2 | 5/2008 |
| WO | WO 2010/083991 | A2 | 7/2010 |
| WO | WO 2010/097596 | A1 | 9/2010 |
| WO | WO 2011/035971 | A2 | 3/2011 |
| WO | WO 2011/048261 | A1 | 4/2011 |
| WO | WO 2011/072502 | A1 | 6/2011 |
| WO | 2012-122159 | A2 | 9/2012 |
| WO | WO 2013/06902 | A1 | 1/2013 |
| WO | 2013027620 | A1 | 2/2013 |
| WO | WO 2014/060760 | A2 | 4/2014 |
| WO | WO 2014/135284 | A1 | 9/2014 |

OTHER PUBLICATIONS

U.S. Appl. No. 14/637,064, filed Mar. 3, 2015, U.S. Pat. No. 9,228,586, Jan. 5, 2016, Pump Integrated With Two Independently Driven Prime Movers.

U.S. Appl. No. 14/862,608, filed Sep. 23, 2015, U.S. Pat. No. 10,072,676, Sep. 11, 2018, System to Pump Fluid and Control Thereof.

U.S. Appl. No. 14/944,368, filed Nov. 18, 2015, U.S. Pat. No. 9,920,755, Mar. 20, 2018, Pump Integrated With Two Independently Driven Prime.

U.S. Appl. No. 15/128,269, filed Sep. 22, 2016, System to Pump Fluid and Control Thereof.

U.S. Appl. No. 15/305,579, filed Apr. 22, 2005, Fluid Delivery System With a Shaft Having a Through-Passage.

U.S. Appl. No. 15/315,560, filed Jun. 2, 2015, Hydrostatic Transmission Assembly and System.

U.S. Appl. No. 15/315,575, filed Jun. 2, 2015, Linear Actuator Assembly and System.

U.S. Appl. No. 15/315,592, filed Jun. 2, 2015, Linear Actuator Assembly and System.

U.S. Appl. No. 15/517,356, filed Oct. 2, 2015, Linear Actuator Assembly and System.

U.S. Appl. No. 15/520,386, filed Oct. 6, 2016, Hydrostatic Transmission Assembly and System.

U.S. Appl. No. 15/756,928, filed Mar. 1, 2018, System to Pump Fluid and Control Thereof.

U.S. Appl. No. 15/756,942, filed Sep. 1, 2016, System to Pump Fluid and Control Thereof.

U.S. Appl. No. 15/887,856, filed Feb. 2, 2018, Pump Integrated With Two Independently Drive Prime Movers.

U.S. Appl. No. 16/118,167, filed Aug. 30, 2018, System to Pump Fluid and Control Thereof.

U.S. Appl. No. 16/374,456, filed Apr. 3, 2019, Fluid Delivery System With a Shaft Having a Through-Passage.

Esposito, Fluid Power with Applicators, 7th Ed., Chapter 5, pp. 154-162 (2009).

International Search Report and Written Opinion, International Applicatoin No. PCT/US2015/018342 (published as WO 2015/131196), 19 pages. (dated Jul. 20, 2015).

International Search Report and Written Opinion, International Application No. PCT/US2015/022484, (published as WO 2015/148662), 9 pages (dated Jun. 9, 2015).

International Search Report and Written Opinion, International Application No. PCT/US2015/027003 (published as WO 2015/164453), 18 pages (dated Nov. 4, 2015).

International Search Report and Written Opinion, International Application No. PCT/US2015/033752 (published as WO 2015/187673), 15 pages (dated Sep. 29, 2015).

International Search Report and Written Opinion, International Application No. PCT/US2015/033764 (published as WO 2015/187681), 7 pages (dated Aug. 19, 2015).

International Search Report and Written Opinion, International Application No. PCT/US2015/033776 (published as WO 2015/187688), 31 pages (dated Oct. 28, 2015).

International Search Report and Written Opinion, International Application No. PCT/US2015/041612 (published as WO 2016/014715), 8 pages (dated Sep. 28, 2015).

International Search Report and Written Opinion, International Application No. PCT/US2015/053670 (published as WO 2015/057321), 10 pages (dated Dec. 16, 2015).

International Search Report and Written Opinion, International Application No. PCT/US2015/054145 (published as WO 2016/064569), 9 pages (dated Feb. 2, 2016).

International Search Report and Written Opinion, International Application No. PCT/US2015/050589 (published as WO 2016/048773), 10 pages (dated Dec. 7, 2015).

(56) References Cited

OTHER PUBLICATIONS

International Search Report and Written Opinion, International Application No. PCT/US2016/049959 (published as WO 2017/040825), 10 pages (dated Dec. 9, 2016).
International Search Report and Written Opinion, International Application No. PCT/US2016/049918 (published as WO 2017/040792), 10 pages (dated Nov. 23, 2016).
Marks' Standard Handbook for Mechanical Engineers, Eighth Ed., Section 14, pp. 14-1-14-31 (1978).
Supplementary European Search Report, EP Application No. 15802457.0, 24 pages (dated Mar. 14, 2018).
Supplementary European Search Report, EP Application No. 15803186.4, 9 pages (dated Dec. 19, 2017).
Supplementary European Search Report, EP Application No. 15803994.1, 7 pages (dated Jan. 22, 2018).
Yusof et al., "Slip flow coefficient analysis in water hydrauilics gear pump for environmental friendly application," *IOP Conf. Series: Materials Science and Engineering*, 50:012016 (2013).

* cited by examiner

EXTERNAL GEAR PUMP INTEGRATED WITH TWO INDEPENDENTLY DRIVEN PRIME MOVERS

PRIORITY

This application is a 371 filing of International Application No. PCT/US2015/041612, which was filed Jul. 22, 2015, and which claims priority to U.S. Provisional Patent Application Nos. 62/027,330 filed Jul. 22, 2014; 62/060,431 filed Oct. 6, 2014; and 62/066,198 filed Oct. 20, 2014, which applications are incorporated herein by reference in their entirety.

TECHNICAL FIELD

The present invention relates generally to pumps and pumping methodologies thereof, and more particularly to pumps and methodologies thereof using two fluid drivers each integrated with an independently driven prime mover.

BACKGROUND OF THE INVENTION

Pumps that transfer fluids can come in a variety of configurations. For example, one such type of pump is a gear pump. Gear pumps are positive displacement pumps (or fixed displacement), i.e. they pump a constant amount of fluid per each rotation and they are particularly suited for pumping high viscosity fluids such as crude oil. Gear pumps typically comprise a casing (or housing) having a cavity in which a pair of gears are arranged, one of which is known as a drive gear that is driven by a driveshaft attached to an external driver such as an engine or an electric motor, and the other of which is known as a driven gear (or idler gear) that meshes with the drive gear. Gear pumps in which both gears are externally toothed are referred to as external gear pumps. External gear pumps typically use spur, helical, or herringbone gears, depending on the intended application. Related art external gear pumps are equipped with one drive gear and one driven gear. When the drive gear attached to a rotor is rotatably driven by an engine or an electric motor, the drive gear meshes with and turns the driven gear. This rotary motion of the drive and driven gears carries fluid from the inlet of the pump to the outlet of the pump. In the above related art pumps, the fluid driver consists of the engine or electric motor and the pair of gears.

However, as gear teeth of the fluid drivers interlock with each other in order for the drive gear to turn the driven gear, the gear teeth grind against each other and contamination problems can arise in the system, whether it is in an open or closed fluid system, due to sheared materials from the grinding gears and/or contamination from other sources. The contamination in closed-loop systems is especially troublesome because the system fluid is recirculated without first going to a reservoir. These sheared materials are known to be detrimental to the functionality of the system, e.g., a hydraulic system, in which the gear pump operates. Sheared materials can be dispersed in the fluid, travel through the system, and damage crucial operative components, such as O-rings and bearings. It is believed that a majority of pumps fail due to contamination issues, e.g., in hydraulic systems. If the drive gear or the drive shaft fails due to a contamination issue, the whole system, e.g., the entire hydraulic system, could fail. Thus, known driver-driven gear pump configurations, which function to pump fluid as discussed above, have undesirable drawbacks due to the contamination problems.

In addition, the related-art systems are configured such that the prime mover (e.g., electric motor) is disposed outside the pump and a shaft extends through the pump casing to couple the motor to the drive gear. The opening in the casing for the shaft, while sealed to prevent fluid from leaking out, can still be a source of contamination. Also, related-art pumps have storage devices, e.g., accumulators, that are disposed separately from the pumps. These systems have interconnecting hoses and/or pipes between the pump and storage device, which introduce additional sources of contamination and increase the complexity of the system design.

Further, with respect to the internal pump configuration, the related-art gear pumps have bearing blocks that are configured to receive the shafts of the gears. The bearing blocks align the two gears such that the center axes of the gears are aligned with each other, such that the intermeshing of the gear teeth of the respective gears is to within an operational tolerance. However, because the bearing blocks in related-art pumps are separate components, seals and/or O-rings must be placed between each block and the corresponding pump casing, which adds to the complexity and weight of the pump assembly and also means more components that can fail.

Related-art systems do not solve the above-identified problems, especially in pumps used in industrial applications such as hydraulic systems. U.S. Patent Application Publication No. 2002/0009368 shows the use of independently driven motors to protect gear tooth surfaces from wear and excess stress in high-torque systems or systems with filler materials in the fluid. However, the motors in the '368 publication are external to the pump and thus would not eliminate all sources of contamination. In addition, the '368 publication does not teach to integrate the pump/prime mover and/or a storage device (e.g., an accumulator) to reduce or eliminate sources of contamination due to interconnections and an external motor configuration. Another related-art publication, WO 2011/035971, discloses a system in which a pump is integrated with a motor. However, the system in the '971 publication is a driver-driven system that can still introduce contamination due to the meshing of gears as discussed above. In addition, the '971 publication does not teach to integrate the pump and a storage device (e.g., an accumulator) to reduce or eliminate sources of contamination due to interconnections. Indeed, this concept is not even applicable because the fluid, i.e., fuel or mixture of urea and water, is consumed by the system and thus not recirculated. Therefore, any contamination has minimal impact, if any, as compared to, e.g., either a closed-loop or open-loop hydraulic system in which the fluid is recirculated. Further, the fuel pump and urea/water pump applications disclosed in the '971 publication are not comparable to the pressures and flows of a typical industrial hydraulics application such as, e.g., an actuator system that operates a boom of an excavator.

Further limitation and disadvantages of conventional, traditional, and proposed approaches will become apparent to one skilled in the art, through comparison of such approaches with embodiments of the present invention as set forth in the remainder of the present disclosure with reference to the drawings.

SUMMARY OF THE INVENTION

Exemplary embodiments of the invention are directed to a pump having a casing in which two fluid drivers are disposed and a method of delivering fluid from an inlet of the pump to an outlet of the pump using the two fluid drivers. As used herein, "fluid" means a liquid or a mixture of liquid and gas containing mostly liquid with respect to volume. Each of the fluid drives includes a prime mover and a fluid displacement member. In some embodiments, the prime mover is partially or completely disposed inside the fluid displacement member. The prime mover drives the fluid displacement member and the prime mover can be, e.g., an electric motor or other similar device that can drive a fluid displacement member. The fluid displacement members transfer fluid when driven by the prime movers. The fluid displacement members are independently driven and thus have a drive-drive configuration. "Independently operate," "independently operated," "independently drive" and "independently driven" means each fluid displacement member is operated/driven by its own prime mover in a one-to-one configuration. For example, each gear in a pump is driven by its own electric motor. The drive-drive configuration eliminates or reduces the contamination problems of known driver-driven configurations.

The fluid displacement member can work in combination with a fixed element, e.g., pump wall or other similar component and/or a moving element such as, e.g., another fluid displacement member when transferring the fluid. The fluid displacement member can be, e.g., an external gear with gear teeth, a hub (e.g. a disk, cylinder, or other similar component) with projections (e.g. bumps, extensions, bulges, protrusions, other similar structures or combinations thereof), a hub (e.g. a disk, cylinder, or other similar component) with indents (e.g., cavities, depressions, voids or similar structures), a gear body with lobes, or other similar structures that can displace fluid when driven. The fluid drivers are independently operated, e.g., with an electric motor or other similar device that can independently operate its fluid displacement member. However, the fluid drivers are operated such that contact between the fluid drivers is synchronized, e.g., in order to pump the fluid and/or seal a reverse flow path. That is, operation of the fluid drivers is synchronized such that the fluid displacement member in each fluid driver makes contact with another fluid displacement member. The contact can include at least one contact point, contact line, or contact area.

In some embodiments, synchronizing contact includes rotatably driving one of a pair of fluid drivers at a greater rate than the other so that a surface of one fluid driver contacts a surface of the other fluid driver. For example, the synchronized contact can be between a surface of at least one projection (bump, extension, bulge, protrusion, another similar structure or combinations thereof) on a first fluid displacement member of a first fluid driver and a surface of at least one projection (bump, extension, bulge, protrusion, another similar structure or combinations thereof) or an indent (cavity, depression, void or another similar structure) on a second fluid displacement member of a second fluid driver. In some embodiments, the synchronized contact seals a reverse flow path (or backflow path).

In an exemplary embodiment, a pump includes a casing defining an interior volume. The pump casing includes two self-aligning balancing plates that can be opposing walls of the pump casing. Each balancing plate includes a protruding portion extending toward the interior volume. Each protruded portion includes two recesses with each recess configured to accept one end of a fluid driver. The recesses can include bearings such as, e.g., sleeve-type bearing between the fluid driver and the wall of the respective recess. The recess portions of a balancing plate are aligned with and face the corresponding recess portions of the other balancing plate when the pump casing is assembled. The balancing plates align the fluid displacement members, i.e., the center axes of the fluid displacement members are aligned with respect to each other, such that the fluid displacement members contact and pump the fluid when rotated. For example, if the fluid displacement members are gears, the center axes of the gears will be aligned such that the respective gear teeth make proper contact with each other when rotated. In some embodiments, the balancing plates include cooling grooves connecting the respective recesses. The cooling grooves ensure that some of the liquid being transferred in the internal volume is directed to the bearings disposed in the recesses as the fluid drivers rotate. In some embodiments, only one self-aligning balancing plate is used and the opposing wall can be an end plate of the casing without the protruded portion.

In another exemplary embodiment, a pump includes a casing defining an interior volume. The pump casing includes two ports in fluid communication with the interior volume. One of the ports is an inlet to the pump and the other port is the outlet. In some embodiments, the pump is bi-directional so that the functions of inlet and outlet can be reversed. The pump includes two fluid drivers disposed within the interior volume. In some exemplary embodiments of the fluid driver, the fluid driver can include an electric motor with a stator and rotor. The stator can be fixedly attached to a support shaft and the rotor can surround the stator. The fluid driver can also include a gear having a plurality of gear teeth projecting radially outwardly from the rotor and supported by the rotor. In some embodiments, a support member can be disposed between the rotor and the gear to support the gear. The gears of the two fluid drivers are disposed such that a tooth of a first gear contacts a tooth of a second gear as the gears rotate. The first and second gears have first and second motor disposed within the respective gear's body. The first motor rotates the first gear in a first direction to transfer the fluid from the pump inlet to the pump outlet along a first flow path. The second motor rotates the second gear, independently of the first motor, in a second direction that is opposite the first direction to transfer the fluid from the pump inlet to the pump outlet along a second flow path. The pump includes a flow converging portion that is disposed between the inlet port and the first and second gears and a flow diverging portion between the first and second gears and the outlet port. The converging portion and the diverging portion reduce or eliminate the turbulence in the fluid as the fluid flows through the pump. The contact between the teeth of the first and second gears is coordinated by synchronizing the rotation of the first and second motors. The synchronized contact seals a reverse flow path (or a backflow path) between the outlet and inlet of the pump. In some embodiments the first motor and second motor are rotated at different revolutions per minute (rpm).

Another exemplary embodiment is directed to a method of delivering fluid from an inlet to an outlet of a pump having a casing to define an interior volume therein, and a first fluid driver with a first prime mover and a first fluid displacement member and a second fluid driver with a second prime mover and a second fluid displacement member. The first fluid displacement member can have a plurality of first projections and indents a second fluid displacement member having at least a plurality of second projections and indents. The pump casing includes two balancing plates that can be opposing walls of the pump casing. Each balancing plate includes a protruding portion extending toward the interior volume. Each protruded portion includes two recesses with each recess configured to accept one end of a fluid driver. In some embodiments, only one self-aligning balancing plate is used and the opposing wall can be an end plate of the casing without the protruded portion.

The method includes disposing each end of each fluid driver in a recess to axially align the fluid displacement members relative to one another. The method further includes rotating the first prime mover to rotate the first fluid displacement member in a first direction to transfer a fluid from the pump inlet to the pump outlet along a first flow path and to transfer a portion of the fluid in the interior volume to a recess. The method includes rotating the second prime mover, independently of the first prime mover, to rotate the second fluid displacement member in a second direction that is opposite the first direction to transfer the fluid from the pump inlet to the pump outlet along a second flow path and to transfer a portion of the fluid in the interior volume to a recess. The method also includes synchronizing a speed of the second fluid displacement member to be in a range of 99 percent to 100 percent of a speed of the first fluid displacement member and synchronizing contact between the first displacement member and the second displacement member such that a surface of at least one of the plurality of first projections (or at least one first projection) contacts a surface of at least one of the plurality of second projections (or at least one second projection) or a surface of at least one of the plurality of indents (or at least one second indent). In some embodiments, the synchronized contact seals a reverse flow path between the inlet and outlet of the pump.

Another exemplary embodiment is directed to a method of transferring fluid from a first port to a second port of a pump that includes a pump casing, which defines an interior volume. The pump casing includes two self-aligning balancing plates that can be opposing walls of the pump casing. Each balancing plate includes a protruding portion extending toward the interior volume. Each protruded portion includes two recesses with each recess configured to accept one end of a fluid driver. In some embodiments, only one self-aligning balancing plate is used and the opposing wall can be an end plate of the casing without the protruded portion. The pump further includes a first fluid driver having a first motor and a first gear having a plurality of first gear teeth, and a second fluid driver having a second motor and a second gear having a plurality of second gear teeth.

The method includes disposing each end of each fluid driver in a recess to axially align the plurality of first and second gear teeth such that they make synchronous contact when the gears are rotated. The method includes rotating the first motor to rotate the first gear about a first axial centerline of the first gear in a first direction. The rotation of the first gear transfers the fluid from the pump inlet to the pump outlet along a first flow path. The method also includes rotating the second motor, independently of the first motor, to rotate the second gear about a second axial centerline of the second gear in a second direction that is opposite the first direction. The rotation of the second gear transfers the fluid from the pump inlet to the pump outlet along a second flow path. In some embodiments, the method further includes synchronizing contact between a surface of at least one tooth of the plurality of second gear teeth and a surface of at least one tooth of the plurality of first gear teeth. In some embodiments, the synchronizing the contact includes rotating the first and second motors at different rpms. In some embodiments, the synchronized contact seals a reverse flow path between the inlet and outlet of the pump.

The summary of the invention is provided as a general introduction to some embodiments of the invention, and is not intended to be limiting to any particular configuration. It is to be understood that various features and configurations of features described in the Summary can be combined in any suitable way to form any number of embodiments of the invention. Some additional example embodiments including variations and alternative configurations are provided herein.

BRIEF DESCRIPTION OF THE DRAWINGS

The accompanying drawings, which are incorporated herein and constitute part of this specification, illustrate exemplary embodiments of the invention, and, together with the general description given above and the detailed description given below, serve to explain the features of preferred embodiments of the invention.

DETAILED DESCRIPTION OF THE PREFERRED EMBODIMENTS

Exemplary embodiments of the present invention are directed to a pump with independently driven fluid drivers disposed between two self-aligning balancing plates that form part of the pump casing. These exemplary embodiments will be described using embodiments in which the pump is an external gear pump with two prime movers, the prime movers are electric motors and the fluid displacement members are external spur gears with gear teeth. However, those skilled in the art will readily recognize that the concepts, functions, and features described below with respect to electric-motor-driven external gear pump with two fluid drivers can be readily adapted to external gear pumps with other gear designs (helical gears, herringbone gears, or other gear teeth designs that can be adapted to drive fluid), to prime movers other than electric motors, e.g., hydraulic motors or other fluid-driven motors, or other similar devices that can drive a fluid displacement member, and to fluid displacement members other than a gear with gear teeth, e.g., a hub (e.g. a disk, cylinder, or other similar component) with projections (e.g. bumps, extensions, bulges, protrusions, other similar structures, or combinations thereof), a hub (e.g. a disk, cylinder, or other similar component) with indents (e.g., cavities, depressions, voids or similar structures), a gear body with lobes, or other similar structures that can displace fluid when driven. In addition, the exemplary embodiments may be described with respect to a hydraulic fluid as the fluid being pumped. However, exemplary embodiments of the present disclosure are not limited to hydraulic fluid and can be used for fluids such as, e.g., water.

Figure 1:
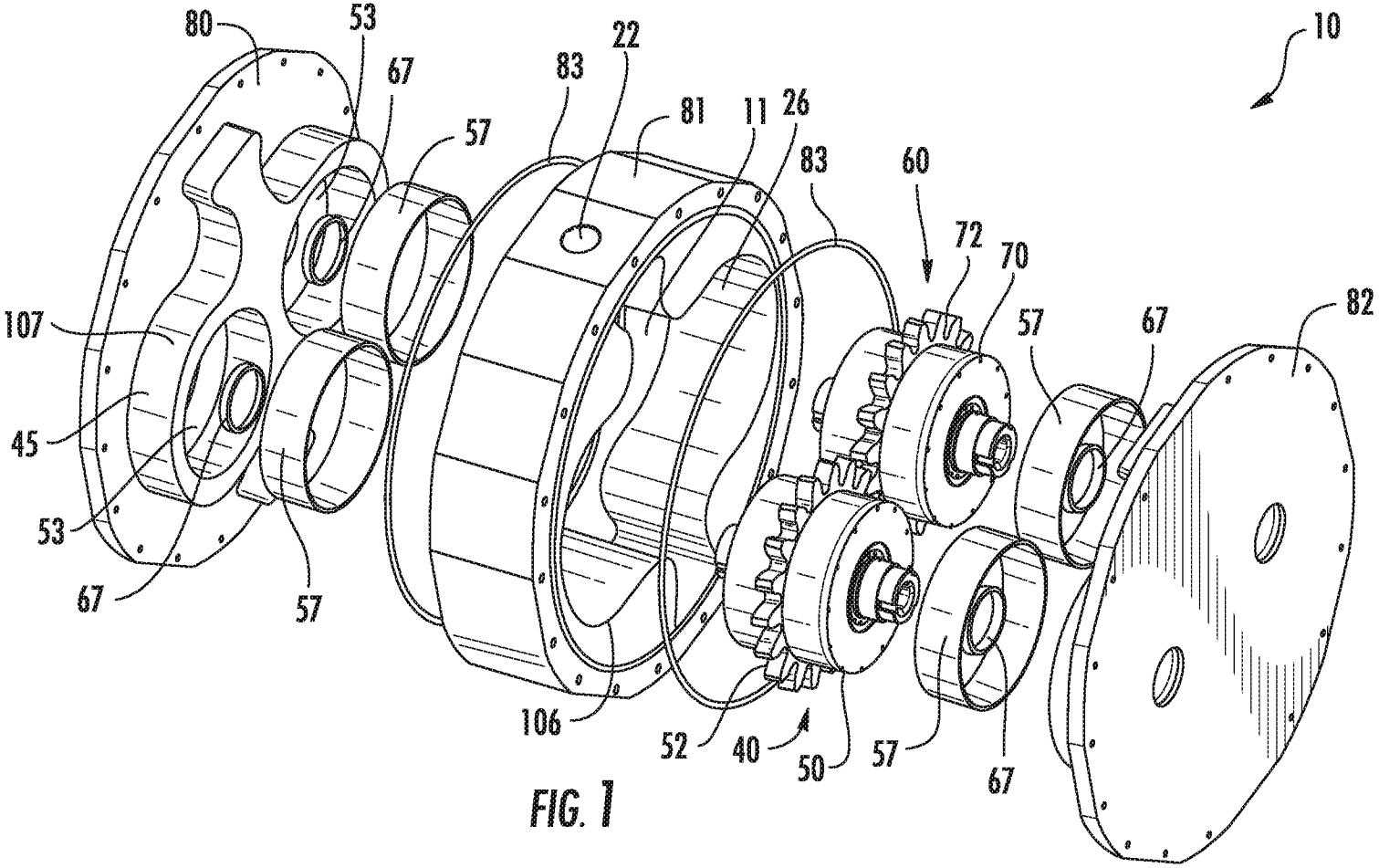
FIG. 1 shows an exploded view of a preferred embodiment of an external gear pump of the present disclosure.

FIG. 1 shows an exploded view of an exemplary embodiment of a pump 10 of the present disclosure. The pump 10 represents a positive-displacement (or fixed displacement) gear pump. The pump 10 includes a casing 20 having end plates 80, 82 and a pump body 81. The inner surface 26 of casing 20 defines an internal volume 11. The internal volume 11 houses two fluid drivers 40, 60. To prevent leakage when assembled, O-rings 83 or other similar devices can be disposed between the end plates 80, 82 and the pump body 81. In some embodiments, one of the end plates 80, 82 and the pump body 81 can be manufactured as a single unit. For example, the end plate 80 and pump body 81 can be machined from a block of metal or cast as a single integrated unit.

The casing 20 has ports 22 and 24 (see FIG. 2), which are in fluid communication with the internal volume 11. During operation and based on the direction of flow, one of the ports 22, 24 is the pump inlet and the other is the pump outlet. In an exemplary embodiment, the ports 22, 24 of the casing 20 are round through-holes on opposing side walls of the casing 20. However, the shape is not limiting and the through-holes can have other shapes. In addition, one or both of the ports 22, 24 can be located on either the top or bottom of the casing. Of course, the ports 22, 24 must be located such that one port is on the inlet side of the pump and one port is on the outlet side of the pump.

As discussed earlier, to ensure proper alignment of the gears, conventional external gear pumps typically include separately provided bearing blocks. However, in some exemplary embodiments, the external gear pump 10 of the present disclosure does not include separately provided bearing blocks. Instead, each of the end plates 80, 82 includes protruded portions 45 disposed on the interior portion (i.e., internal volume 11 side) of the end plates 80, 82, thereby eliminating the need for separately provided bearing blocks. That is, one feature of the protruded portions 45 is to ensure that the gears are properly aligned, a function performed by bearing blocks in conventional external gear pumps. However, unlike traditional bearing blocks, the protruded portions 45 of each end plate 80, 82 provide additional mass and structure to the casing 20 so that the pump 10 can withstand the pressure of the fluid being pumped. In conventional pumps, the mass of the bearing blocks is in addition to the mass of the casing, which is designed to hold the pump pressure. Thus, because the protruded portions 45 of the present disclosure serve to both align the gears and provide the mass required by the pump casing 20, the overall mass of the structure of pump 10 can be reduced in comparison to conventional pumps of a similar capacity.

As seen in FIG. 1, the pump body (or mid-section) 81 has a generally circular shape. However, the pump body 81 is not limited to a circular shape and can have other shapes. The balancing plates 80, 82 are attached on each side of the pump body 81 when assembled. The contour of the interior surface 106 of the pump body 81 may substantially match the contour of the exterior line 107 of the protruded portion 45 such that the internal volume 11 of the pump 10 is formed in the casing 20 when the pump 10 is fully assembled. The dimension of the pump body 81 may vary depending on the design needs of the pump 10. For example, if increased pumping capacity is needed, the radial diameter and/or width of the pump body 81 may be increased appropriately to satisfy the design needs.

Figure 1A:
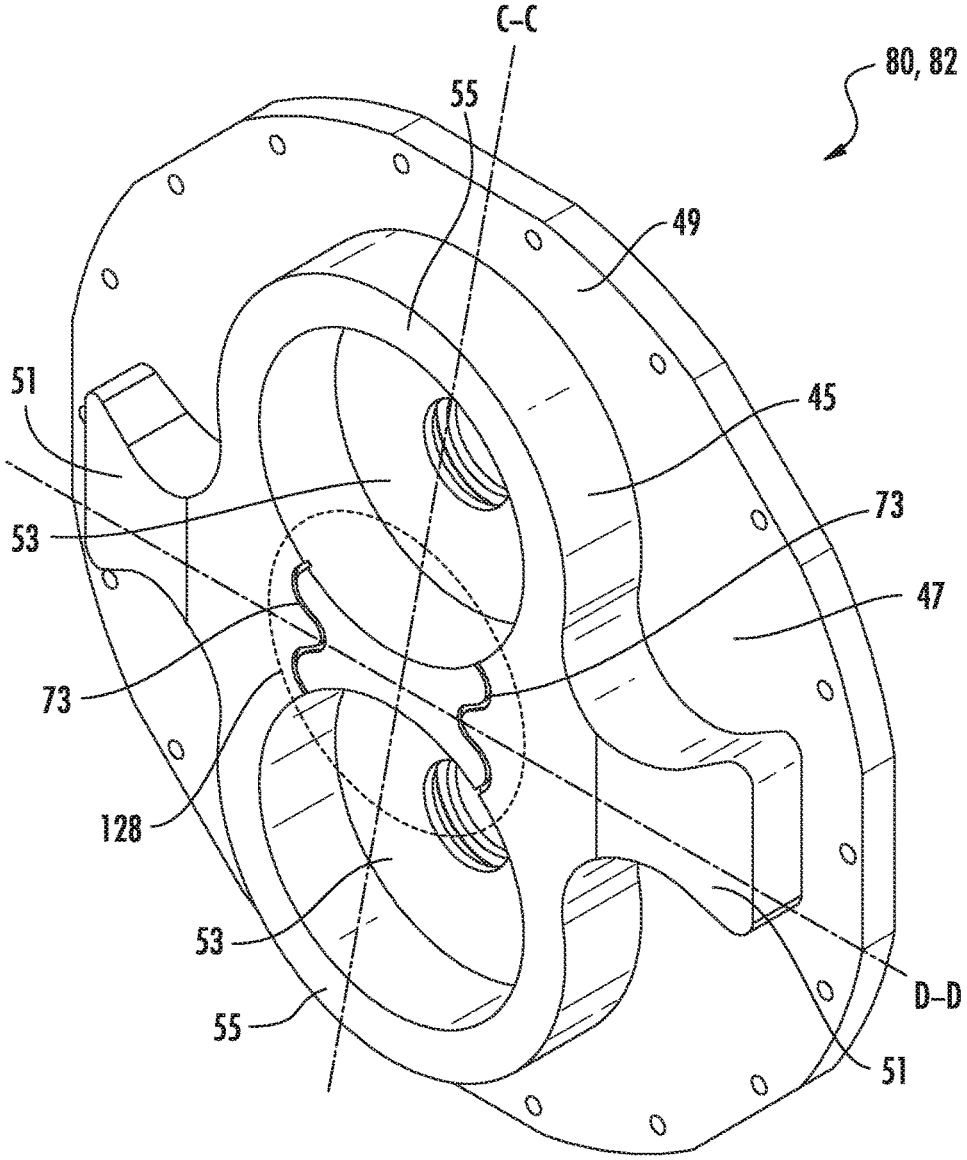
FIG. 1A shows an isometric view of a balancing plate of the pump of FIG. 1.

As seen in FIG. 1A, the protruded portion 45 of each balancing plate 80, 82 has a center segment 49 and side segments 51. In some exemplary embodiments, e.g., as shown in FIG. 1A, the center segment 49 and the side segments 51 can be one continuous structure, which can have a generally figure 8-shaped configuration. The center segment 49 has two recesses 53 that can be, e.g., cylindrical in shape. The two recesses 53 are each configured to receive an end of the fluid drivers 40, 60. The dimensions of the recesses 53, e.g., the diameter and depth of the recesses 53, can be based on, e.g., the physical size of the fluid drivers 40, 60 and the thickness of the gear teeth 52, 72. For example, the diameter of the recess 53 can depend on the diameter of fluid driver 40, 60, which will typically depend on the physical size of the motors. The size of the motors in the fluid drivers 40, 60 can vary depending on the power requirements of a particular application. The diameter of each recess 53 is sized to allow the outer casing of the fluid drivers 40, 60 to rotate freely but to also limit lateral movement of the fluid driver with respect to its axis.

Figure 1B:
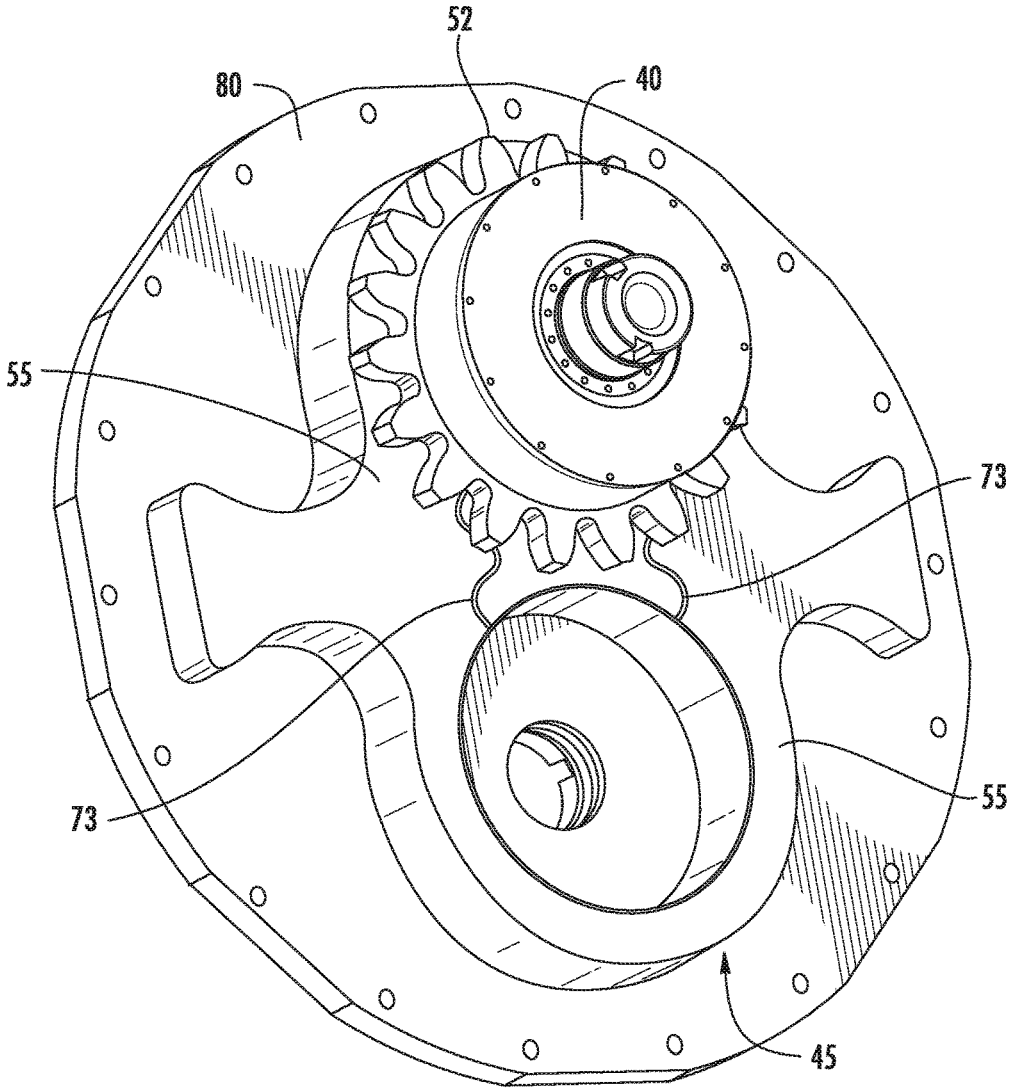
FIG. 1B shows an isometric view of a motor assembly and balancing plate with the motor assembly disposed in the balancing plate.
Figure 2:
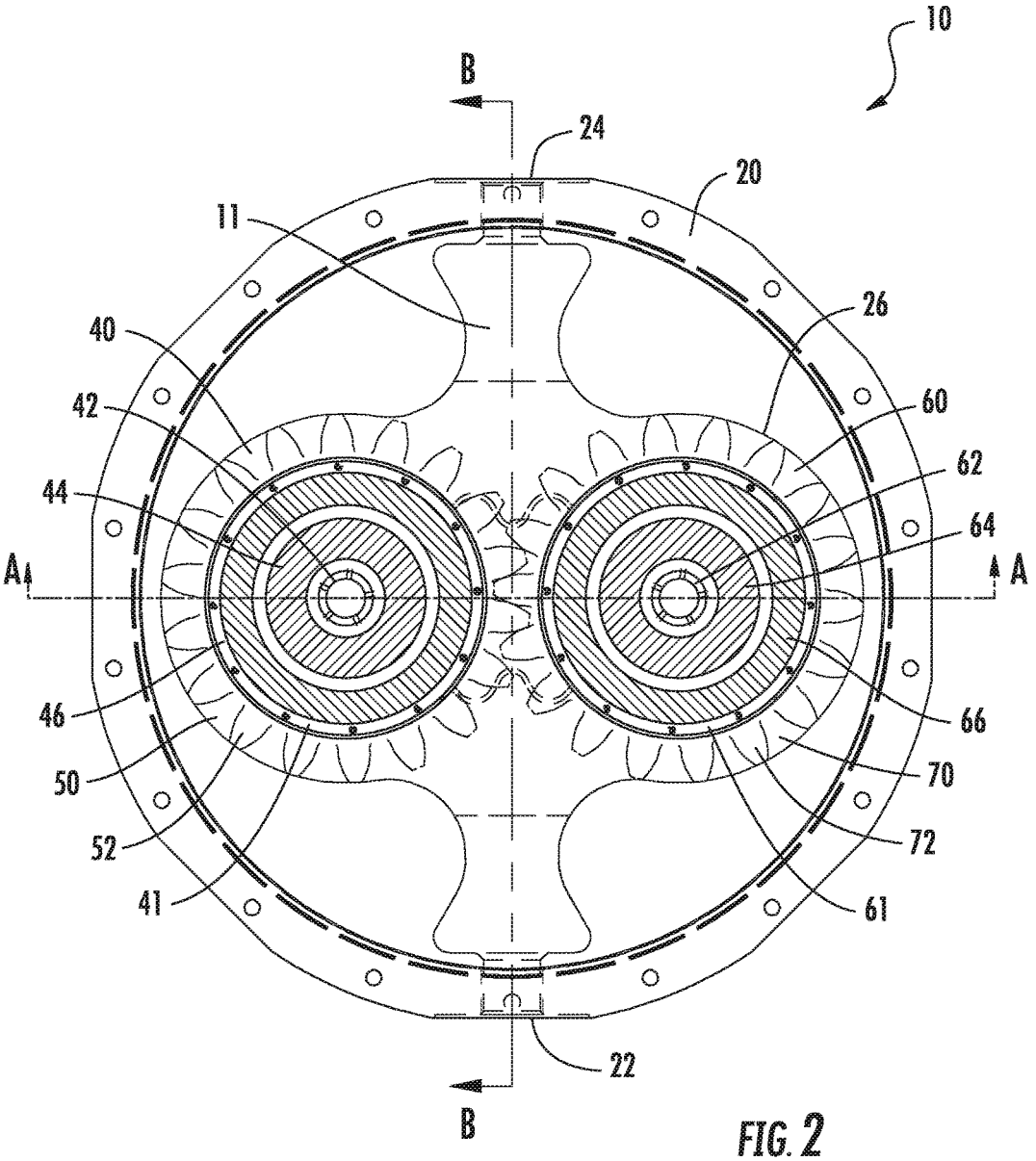
FIG. 2 shows a top cross-sectional view of the external gear pump of FIG. 1.

As seen in FIG. 1, the fluid drivers 40, 60 include gears 50, 70 which have a plurality of gear teeth 52, 72 extending radially outward from the respective gear bodies. When the pump 10 is assembled, the gear teeth 52, 72 fit in a gap between land 55 of the protruded portion of balancing plate 80 and the land 55 of the protruded portion of balancing plate 82. Thus, the protruded portions 45 are sized to accommodate the thicknesses of gear teeth 52, 72, which can depend on various factors such as, e.g., the type of fluid being pumped and the design flow and pressure capacity of the pump. The gap between the opposing lands 55 of the protruded portions 45 is set such that there is sufficient clearance between the lands 55 and the gear teeth 52, 72 for the fluid drivers 40, 60 to rotate freely but still pump the fluid efficiently. The depth of each recess 53 will determine the gap width. The depth of the recess 53 will depend on the length of the motor and the thickness of the gear teeth 52, 72. The depth of each recess 53 is appropriately sized to align the top and bottom surfaces of the gear teeth 52, 72 to the lands 55 of the protruded portions 45. For example, as seen in FIG. 1B, the depth of the recess 53 is set so that the bottom surface of gear teeth 52 of gear 50 is aligned with land 55 of balancing plate 80 when the fluid driver 40 is fully inserted into the recess 53. As discussed above, this alignment allows the fluid drivers to rotate freely but still efficiently transfer fluid from the inlet of pump 10 to the outlet of pump 10 when the gears 50, 70 are rotated by the prime movers such as, e.g., electric motors. The bottom surface of gear teeth 72 of gear 70 (not shown in FIG. 1B) will also align with land 55 when fluid driver 60 is inserted in the other recess 53 of balancing plate 80. Similarly, the top surfaces of gear teeth 52, 72 will align with land 55 of balancing plate 82 when the other ends of fluid drivers 40, 60 are inserted into the recesses 53 of end plate 82. The distance between the centers of the recesses 53 in each balancing plate 80, 82 is set to properly align the fluid displacement members of the fluid drivers 40, 60 with respect to each other. Accordingly, as shown in FIGS. 2 to 2B, when fully assembled, the protruded portions 45 ensure that the gears 50 and 70 are aligned, i.e., the center axes of the gears 50, 70 are aligned with each other, and also ensure that the top and bottom surfaces of the gears 50, 70 and the respective lands 55 are aligned.

In some embodiments, only one of the plates 80, 82 has protruded portion 45. For example, end plate 80 can include a protruded portion 45 and the end plate 82 can be a cover plate with appropriate features such as, e.g., openings to accept the shafts of the fluid drivers 40, 60. In such embodiments, the gears 50, 70 can be disposed on an end of the fluid drivers 40, 60 (not shown) instead of in the center of the fluid drivers 40, 60 as shown in FIG. 1. In the exemplary embodiments in which the gears are disposed on an end of the fluid drivers, the protruded portion and the pump body are sized such that a gap exists between the land of the protruded portion and the end cover plate to accommodate the gear teeth. In some embodiments, the end plate 80 and the pump body 81 can be manufactured as a single unit. For example, the end plate 80 and pump body 81 can be machined from a block of metal or cast as a single integrated unit. The single unit 80/81 can include the protruded portion 45 while the end plate 82 is the end cover plate. Alternatively, the end plate 82 can include the protruded portion 45 while the single unit 80/81 is a cover vessel. Thus, in exemplary embodiments of the present disclosure, the protruded portion 45 can be included in both end plates of the casing (or both an end plate and a cover vessel or in only one end plate of the casing (or only in the cover vessel), depending on the casing configuration. In each configuration, the protruded portion(s) 45 of the casing 20 aligns the fluid drivers 40, 60 with respect to each other when the pump is assembled. Thus, exemplary embodiments of the present disclosure provide a self-aligning casing as it relates to the fluid drivers 40, 60.

Figure 2A:
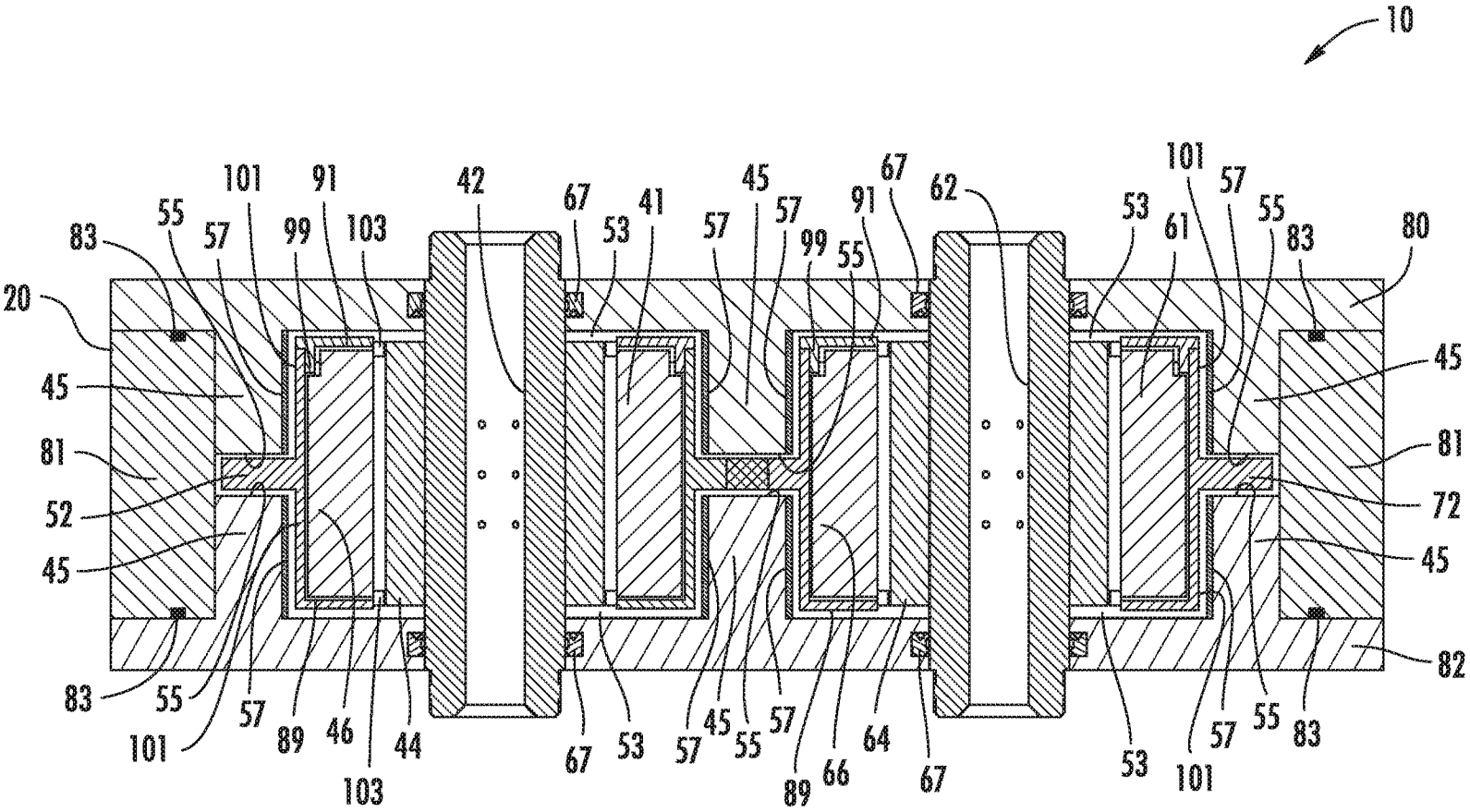
FIG. 2A shows a side cross-sectional view taken along line A-A of the external gear pump of FIG. 2.
Figure 2B:
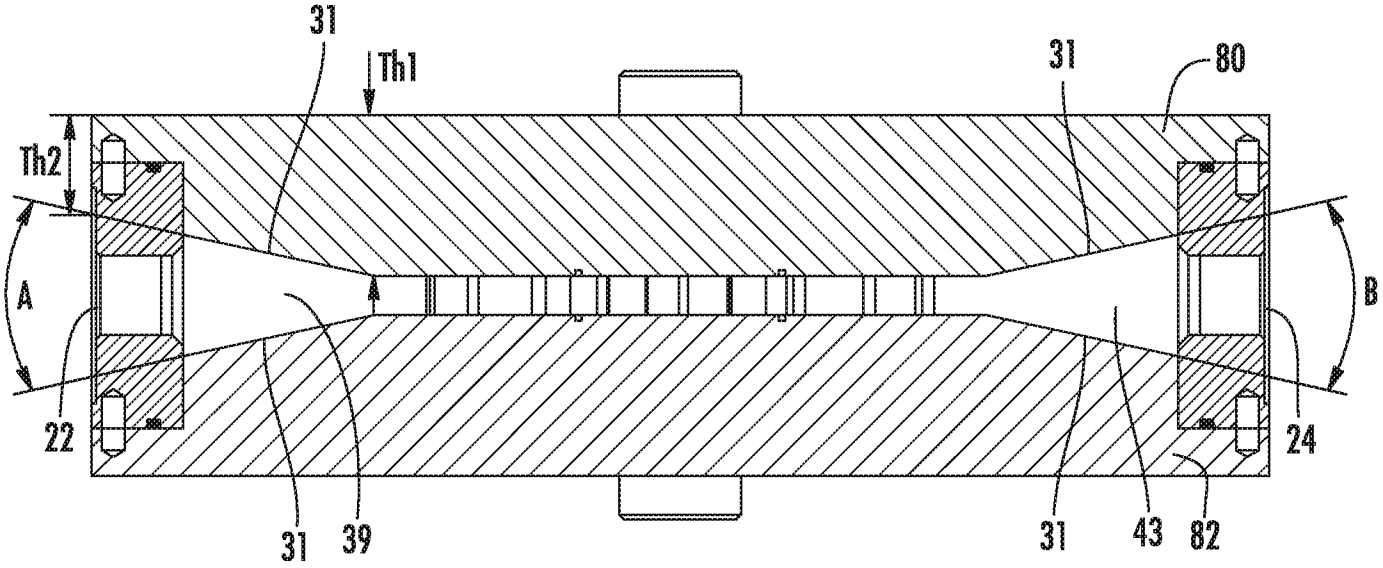
FIG. 2B shows a side cross-sectional view taken along a line B-B of the external gear pump of FIG. 2.

Preferably, as seen in FIGS. 1 and 2A, bearings 57 can be disposed between the fluid drivers 40, 60 and the respective recesses 53, e.g., in the inner bore of recesses 53, to ensure smooth rotation and limit wear and lateral movement on the fluid drivers 40, 60. In an exemplary embodiment, the bearings 57 can be sliding or sleeve bearings. The material composition of the bearing is not limiting and can depend on the type of fluid being pumped. Depending on the fluid being pumped and the type of application, the bearing can be metallic, a non-metallic or a composite. Metallic material can include, but is not limited to, steel, stainless steel, anodized aluminum, aluminum, titanium, magnesium, brass, and their respective alloys. Non-metallic material can include, but is not limited to, ceramic, plastic, composite, carbon fiber, and nano-composite material. For example, the bearings 57 can be a composite dry sliding bushing/bearing such as SKF PCZ-11260B™. However, in other embodiments, a different type of dry sliding bearing can be used. Further, in some embodiments, other types of bearings can be utilized, for example, lubricated roller bearings. Thus, any type of bearings that can withstand the loads from the pump 10 and properly function during the operation of the pump 10 can be utilized without departing from the spirit of the present disclosure.

In some embodiments, one or more cooling grooves may be provided in each protruded portion 45 to transfer a portion of the fluid in the internal volume 11 to the recesses 53 to lubricate bearings 57. For example, as shown in FIG. 1A, cooling grooves 73 can be disposed on the surface of the land 55 of each protruded portions 45. At least one end of each cooling groove 73 extends to a recess 53 and opens into the recess 53 such that fluid in the cooling groove 73 will be forced to flow to the recess 53. In some embodiments, both ends of the cooling grooves extend to and open into recesses 53. For example, in FIG. 1A, the cooling grooves 73 are disposed between the recesses 53 in a gear merging area 128 such that the cooling grooves 73 extend from one recess 53 to the other recess 53. Alternatively, or in addition to the cooling grooves 73 disposed in the gear merging area 128, other portions of the land 55, i.e., portions outside of the gear merging area 128, can include cooling grooves. Although two cooling grooves are illustrated, the number of cooling grooves in each balancing plate 80, 82 can vary and still be within the scope of the present disclosure. In some exemplary embodiments (not shown), only one end of the cooling groove opens into a recess 53, with the other end terminating in the land 55 portion or against interior wall 90 when assembled. In some embodiments, the cooling grooves can be generally "U-shaped" and both ends can open into the same recess 53. In some embodiments, only one of the two protruded portions 45 includes the cooling groove(s). For example, depending on the orientation of the pump or for some other reason, one set of bearings may not require the lubrication and/or cooling. For pump configurations that have only one protruded portion 45, in some embodiments, the end cover plate (or cover vessel) can include cooling grooves either alternatively or in addition to the cooling grooves in the protruded portion 45, to lubricate and/or cool the motor portion of the fluid drivers that is adjacent the casing cover.

Turning to the exemplary embodiment shown in FIG. 1A, each cooling groove 73 has a curved or wavy profile and is disposed substantially perpendicular to an axis connecting ports 22 and 24 (not shown), e.g. the axis D-D. Further, in some embodiments, the grooves 73 are disposed symmetrically with respect to the center line C-C connecting the center of shaft 42 and shaft 62. As gear teeth 52, 72 rotate, fluid is flung onto the surface of land 55 in each protruded portion 45 due to the pressure created by the rotating gears. The pressure of the fluid against the land 55 increases as the rotating speed of each fluid driver 40, 60 increases. As the gear teeth 52, 72 rotate, a portion of fluid being transferred by the gears 50, 70 enters into the cooling grooves 73 and, due to a pressure difference, the fluid flows toward the open end of each cooling groove 73 at the recesses 53. In this way, the bearings 57, which are disposed in the recesses 53, continuously receive fluid for cooling and/or lubrication while the pump 10 operates. As discussed above, the type of bearing will depend on the fluid being pumped. For example, if water is being pumped, a composite bearing can be used. If hydraulic fluid is being pumped, a metal or composite bearing can be used. In the exemplary embodiments discussed above, the cooling grooves 73 have a profile that is curved and in the form of a wave shape. However, in other embodiments, the cooling grooves 73 can have other groove profiles, e.g. a zig-zag profile, an arc, a straight line, or some other profile that can transfer the fluid to recesses 53. The dimension (e.g., depth, width), groove shape and number of grooves in each balancing plate 80, 82 can vary depending on the cooling needs and/or lubrication needs of the bearings 57.

As best seen in FIG. 2B, which shows a cross-sectional view of pump 10 along axis B-B in FIG. 2, in some embodiments, the balancing plates 80, 82 include sloped (or slanted) segments 31 at each port 22, 24 side of the balancing plates 80, 82. In some exemplary embodiments, the sloped segments 31 are part of the protruded portions 45. In other exemplary embodiments, the sloped segment 31 can be a separate modular component that is attached to protruded portion 45. Such a modular configuration allows for easy replacement and the ability to easily change the flow characteristics of the fluid flow to the gear teeth 52, 72, if desired. The sloped segments 31 are configured such that, when the pump 10 is assembled, the inlet and outlet sides of the pump 10 will have a converging flow passage or a diverging flow passage, respectively, formed therein. Of course, either port 22 or 24 can be the inlet port and the other the outlet port depending on the direction of rotation of the gears 50, 70. The flow passages are defined by the sloped segments 31 and the pump body 81, i.e., the thickness Th2 of the sloped segments 31 at an outer end next to the port is less than the thickness Th1 an inner end next to the gears 50, 70. As seen in FIG. 2B, the difference in thicknesses forms a converging/diverging flow passage 39 at port 22 that has an angle A and a converging/diverging flow passage 43 at port 24 that has an angle B. In some exemplary embodiments, the angles A and B can be in a range from about 9 degrees to about 15 degrees, as measured to within manufacturing tolerances. The angles A and B can be the same or different depending on the system configuration. Preferably, for pumps that are bi-directional, the angles A and B are the same, as measured to within manufacturing tolerances. However, the angles can be different if different fluid flow characteristics are required or desired based on the direction of flow. For example, in a hydraulic cylinder-type application, the flow characteristics may be different depending on whether the cylinder is being extracted or retracted. The profile of the surface of the sloped section can be flat as shown in FIG. 2B, curved (not shown) or some other profile depending on the desired fluid flow characteristics of the fluid as it enters and/or exits the gears 50, 70.

During operation, as the fluid enters the inlet of the pump 10, e.g., port 22 for exemplary purposes, the fluid encounters the converging flow passage 39 where the cross-sectional area of at least a portion of the passage 39 is gradually reduced as the fluid flows to the gears 50, 70. The converging flow passage 39 minimizes abrupt changes in speed and pressure of the fluid and facilitates a gradual transition of the fluid into the gears 50, 70 of pump 10. The gradual transition of the fluid into the pump 10 can reduce bubble formation or turbulent flow that may occur in or outside the pump 10, and thus can prevent or minimize cavitation. Similarly, as the fluid exits the gears 50. 70, the fluid encounters a diverging flow passage 43 in which the cross-sectional areas of at least a portion of the passage is gradually expanded as the fluid flows to the outlet port, e.g., port 24. Thus, the diverging flow passage 43 facilitates a gradual transition of the fluid from the outlet of gears 50, 70 to stabilize the fluid.

An exemplary embodiment of the fluid drivers 40, 60 is given with reference to FIGS. 2 and 2A. FIG. 2 shows a top cross-sectional view of the pump 10 of FIG. 1. FIG. 2A shows a side cross-sectional view taken along a line A-A in FIG. 2 of the pump 10. As seen in FIGS. 2 and 2A, fluid drivers 40, 60 are disposed in the internal volume 11 of casing 20. The fluid driver 40 includes motor 41 and gear 50, and the fluid driver 60 includes motor 61 and gear 70. The support shafts 42, 62 of the fluid drivers 40, 60 are disposed between the port 22 and the port 24 of the casing 20 and are supported by the balancing plate 80 at one end and the balancing plate 82 at the other end. However, the means to support the shafts 42, 62 and thus the fluid drivers 40, 60 are not limited to this design and other designs to support the shaft can be used. For example, the shafts 42, 62 can be supported by blocks that are attached to the casing 20 rather than directly by casing 20, e.g., in some exemplary embodiments where the end cover plate or cover vessel does not include a protruding portion 45. The support shaft 42 of the fluid driver 40 is disposed in parallel with the support shaft 62 of the fluid driver 60 and the two shafts are separated by an appropriate distance so that the gear teeth 52, 72 of the respective gears 50, 70 contact each other when rotated. As discussed above, in some exemplary embodiments, the protruding portion 45 of each balancing plate 80, 82 provides the proper alignment between gears 50, 70 of the fluid drivers 40, 60. In exemplary embodiments where the shafts 42, 62 of the fluid drivers 40, 60 extend outside the casing 20, seals 67 can be disposed on the shafts 42, 62 of the fluid drivers 40, 60 to seal the recess 53 from the outside see, e.g., FIG. 2A. In an exemplary embodiment, the plurality of seals 67 can be SKF ZBR rod pressure Seals™, e.g. a model No. ZBR-60X75X10-E6W™. However, other types of seals may be used without departing from the spirit of the present disclosure. In addition, in other embodiments, the balancing plates 80, 82 may be configured such that the support shafts 42, 62 do not extend to the outside of the casing 20. For example, the thicknesses of the balancing plates 80, 82 may be sufficient to support the shafts 42, 62 without the need to extend outside the casing 20. This type of configuration further limits the potential for contamination because there are fewer openings in the pump casing.

Turning to the motors 41, 61 of the fluid drivers 40, 60, the stators 44, 64 are disposed radially between the respective support shafts 42, 62 and the rotors 46, 66. The stators 44, 64 are fixedly connected to the respective support shafts 42, 62, which are fixedly connected to the casing 20. The rotors 46, 66 are disposed radially outward of the stators 44, 64 and surround the respective stators 44, 64. Thus, the motors 41, 61 in this embodiment are of an outer-rotor motor design (or an external-rotor motor design), which means that that the outside of the motor rotates and the center of the motor is stationary. In contrast, in an internal-rotor motor design, the rotor is attached to a central shaft that rotates. In an exemplary embodiment, the motors 41, 61 are multi directional electric motors. That is, either motor can operate to create rotary motion that is either clockwise or counter-clockwise depending on operational needs. Further, in an exemplary embodiment, the motors 41, 61 are variable-speed, variable-torque motors in which the speed and/or torque of the rotor and thus the attached gear can be varied to create various volume flows and pump pressures.

Figure 3:
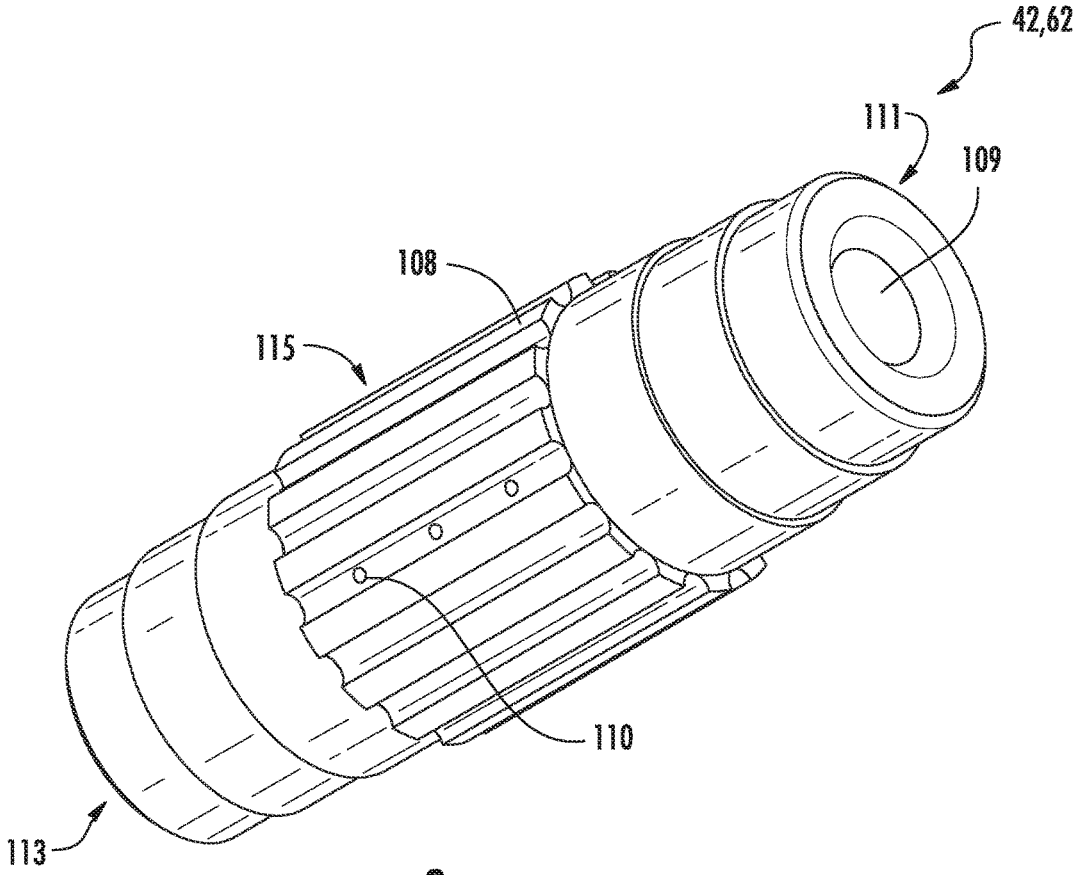
FIG. 3 shows an isometric view of an exemplary embodiment of a support shaft that can be used in the pump of FIG. 1.

FIG. 3 shows an isometric view of an exemplary embodiment of the support shafts 42, 62. The first support shaft 42 may be a generally cylindrical and hollow shaft. However, in some embodiments, the shaft can be solid. In the exemplary embodiment of FIG. 3, a passage 109 extends the length of the support shafts 42, 62 along the center line. A cap (not shown) may be provided on each end of the support shafts 42, 62 in some embodiments. The support shafts 42, 62 may have a splined portion 108 on its outer surface in a central area 115 in the axial direction of the shaft. Each stator 44, 64 may have a mating spline portion (not shown) that fits on the corresponding splined portion 108 of the respective support shaft 42, 62 when the pump 10 is fully assembled. In this way, each stator 44, 64 is fixedly attached to the respective support shaft 42, 62 which is in turn fixedly attached to the casing 20. A plurality of through holes 110 can be disposed on the support shaft 42, 62. Each of the through holes 110 fluidly connects between the outer surface of the support shaft 42, 62 and the passage 109 inside the support shaft 42, 62. Cooling fluid, e.g. an external cooling fluid such as air, may be circulated to the motor 41, 61 via the ends 111, 113 of the support shaft 42, 62 and the through holes 110. In some embodiments, the pump can be configured such that the fluid being pumped is circulated via the end 111, 113 and holes 110. The diameter and number of through holes 110 can be set based on the desired cooling characteristics of the motor, the cooling fluid, the type of fluid being pumped and the pump application.

Figure 4:
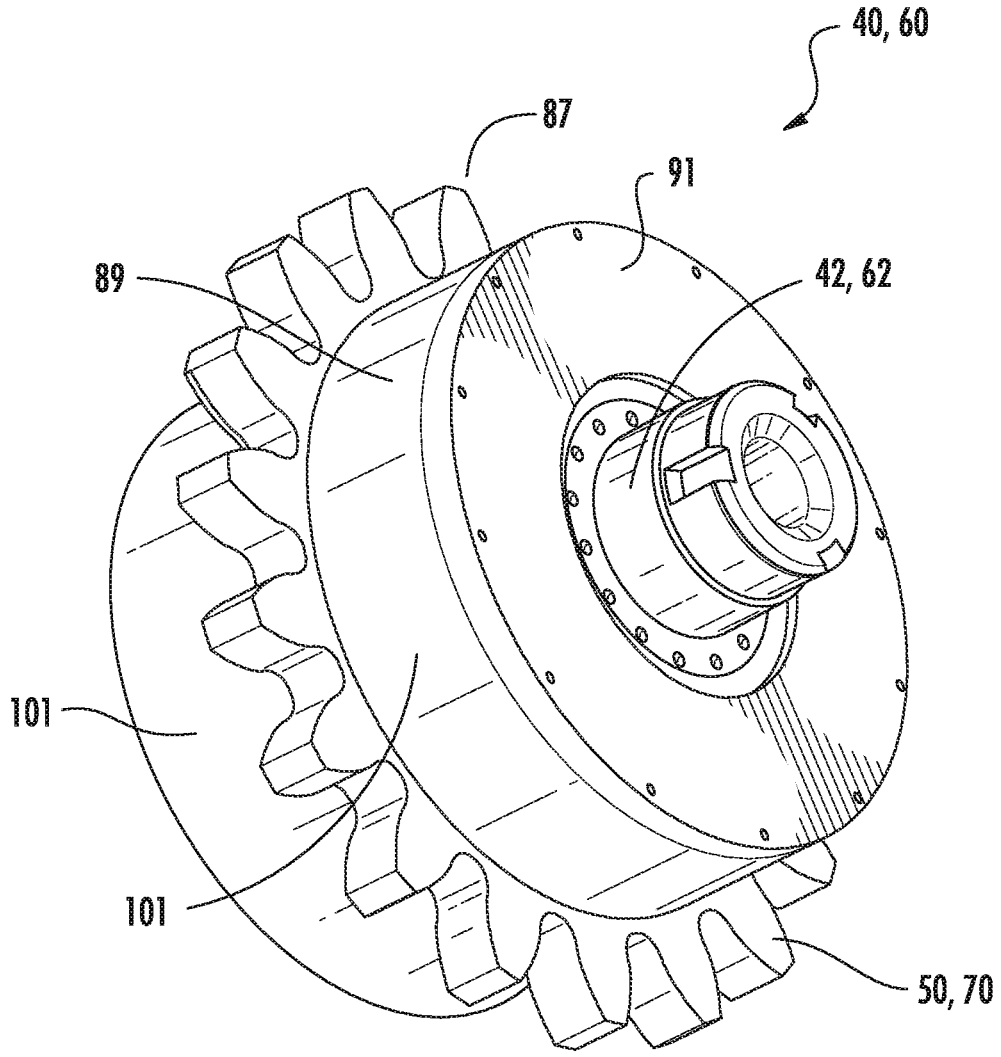
FIG. 4 shows an isometric view of an exemplary embodiment of a motor casing assembly that can be used in the pump of FIG. 1.

Each fluid driver 40, 60 includes a motor casing that houses the respective shafts 42, 62, stators 44, 64 and rotors 46, 66 of the motors 41, 61. In some embodiments, the casings of the motors 41, 61 and the respective gears 50, 70 form a single unit. For example, FIG. 4 shows an isometric view of an exemplary embodiment of a motor casing assembly 87 that includes a motor casing body 89, motor casing cap 91 and gears 50, 70. FIG. 2A shows a cross-sectional view of pump 10 in which fluid drivers 40, 60 each including the casing body 89 and the cap 91. As seen in FIG. 2A, motors 41 and 61 are each disposed within their respective casing bodies 89. The casing bodies 89 of each fluid driver 40, 60 are fixedly attached to the respective rotors 46, 66. Thus, when the rotors 46, 66 rotate, the respective casing bodies 89, including the gears 50, 70, will also rotate. Each of the motors 41 and 61 include bearings 103 disposed between the fixed stators 44, 64 and the rotors 46, 66. In some embodiments, the motor bearings 103 can be enclosed bearings and do not need the fluid being pumped for lubrication. In other embodiments, the motor bearings 103 can use the fluid being pumped for lubrication, e.g., when pumping hydraulic fluid. As seen in FIG. 4, the motor casing cap 91 is disposed on an end of the motor casing body 89. The motor casing body 89 may be fixedly connected to the motor casing cap 91 by, e.g., a plurality of screws. However, the connecting method between the motor casing body 89 and the motor casing cap 91 of the present disclosure is not limited to the above-described screw connection. A different method such as bolts or some other attachment method may be used without departing from the spirit of the present disclosure. In some embodiments, an O-ring or some type of gasket material or sealant may be used between the motor casing cap 91 and the motor casing body 89 to ensure that the casing interior is isolated from the fluid being transferred.

Figure 4A:
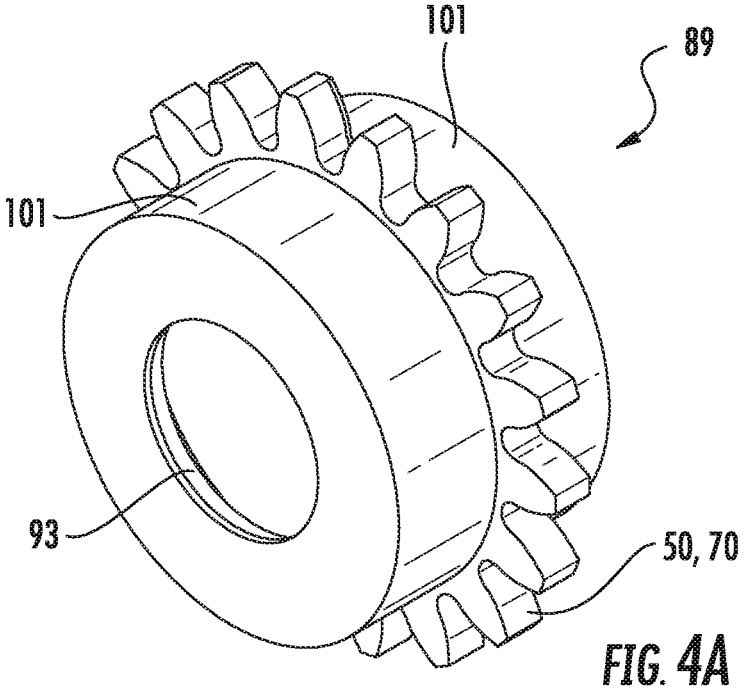
FIGS. 4A and 4B show isometric views of an exemplary embodiment of the motor casing of FIG. 4.
Figure 4B:
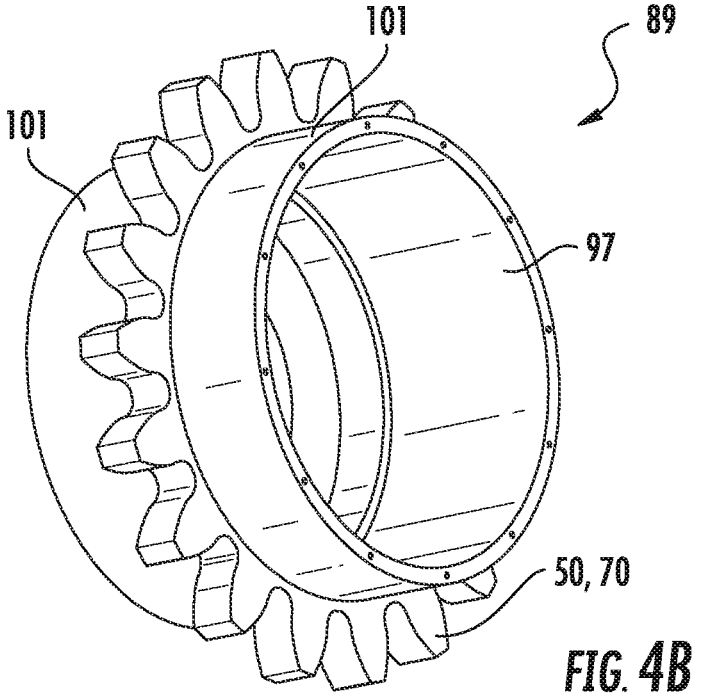
Figure 4C:
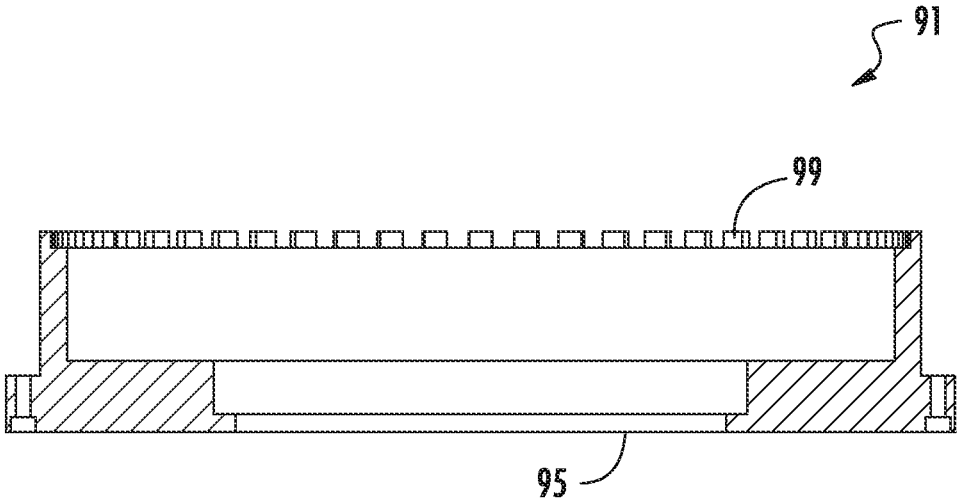
FIG. 4C shows a side cross-sectional view of an exemplary embodiment of the motor casing cap of FIG. 4.

As seen in FIGS. 4A and 4B, each motor casing body 89 has an opening 97 to receive the respective rotor/stator/shaft assembly and an opening 93 to receive one of the two motor bearings 103. As seen in FIG. 4C, the motor casing cap 91 has an opening 95 to receive the other of the two motor bearings 103. An interface between the motor bearings 103 and the openings 93, 95 forms a seal such that, when the pump 10 is fully assembled, the interior of the motor casing assembly 87 is isolated from the fluid being pump if desired. However, in some embodiments, depending on the type of fluid, motors 41, 61 will not be adversely affected by the fluid being pumped and the interior of the motor casing assembly 87 need not be sealed. For example, in some embodiments, the motors 41, 61 can tolerate hydraulic fluid and in these embodiments, a perfect seal is not needed. The seal between the motor bearings 103 and the openings 93, 95 can be formed by a press fit, interference fit, or by some other method that will attach the bearings 103 to the openings 93, 95 and, in some embodiments, isolate the fluid from the interior of the motor casing assembly 87. When the pump 10 is fully assembled, the stators 44, 64 are fixedly connected to the respective support shafts 42, 62, which extend out of the respective motor casing assemblies 87 and are fixedly connected to the casing 20, as shown in FIG. 2A. The bearings 103 ensure that the rotors 46, 66 along with the respective motor casing assembly 87 can still freely rotate around the respective stators 44, 64 and support shafts 42, 62.

As seen in FIGS. 2A and 4, the motor casing bodies 89 of the respective fluid drivers 40, 60 have bearing surfaces 101 on their outer radial surface on each side of the respective gears 50, 70. When the pump 10 is fully assembled, the bearing surfaces 101 are disposed in the recesses 53. As shown in FIGS. 1 and 2A, the bearings 57 are disposed between the bearing surfaces 101 of the first motor casing 89 and the respective recesses 53. In some embodiments where only one protruded portion 45 is used, the casing body 89 can have only one bearing surface 101.

FIG. 4C shows a side cross-sectional view of an exemplary embodiment of the motor casing cap 91. As discussed above, the motor casing cap 91 may include a spline (or protrusions) 99 on its inner rim. This spline 99 may engage with a mating spline (not shown) or a mating surface (not shown) in the respective motor rotor 46, 66, which the spline 99 can "grip" when the pump 10 is fully assembled. In this way, the rotors 46, 66 and the respective motor casing assembly 87 can become one rotary entity, i.e. the respective motor casing assemblies 87 are fixedly connected to the rotors 46, 66. However, the method of attaching the rotors 46, 66 to the respective motor casing assembly 87 of the present disclosure is not limited to the above-described spline connection. Other methods such as bolts, screws, indentations, grooves, notches, bumps, brackets, or some other attachment method may be used without departing from the spirit of the present disclosure. Additionally or alternatively, in some embodiments, the inner surface, e.g., the base and/or sidewalls, of the motor casing body 89 has indentations, grooves, notches, bumps, brackets, projections, etc. that grip the respective rotor 46, 66 such that the motor casing assembly 87 and the respective rotor 46, 66 become one rotary entity. Additionally or alternatively, the interface between the motor bearings 103 and openings 93, 95 can also serve to attach first rotor 46 to the first motor casing 89 such that they become a rotary entity.

In a preferred embodiment, the gear teeth 52, 72 are formed on and are part of the respective motor casing body 89. That is, the gear bodies of gears 50, 70 and the motor casing of motors 41, 61 are the same. Thus, the motor casing bodies 89 and their respective gear teeth 52, 72 are provided as one piece. For example, the outer surfaces of motor casing body 89 can be machined to form the gear teeth 52, 72 in the center of the casing body 89 as shown in FIGS. 4, 4A and 4B or, for embodiments that, e.g., only have one protruded portion 45, the outer surfaces of motor casing body 89 can be machined to form the gear teeth 52, 72 at an end of the casing body 89 (not shown). In another exemplary embodiment, the motor casing body 89 may be cast such that the mold includes the gear teeth 52, 72.

However, in other exemplary embodiments, the gears 50, 70 can be manufactured separately from the motor casing body 89 and then joined. For example, a ring-shaped gear assembly that includes the gear teeth can be manufactured and joined to the motor casing via a welding process, for example. Of course, other methods can be used to join the two components, e.g., a press fit, an interference fit, bonding, or some other means of attachment. As such, the manufacturing method of the motor casing/gear can vary without departing from the spirit of the present disclosure. In addition, in some embodiments, the motor casing assembly 87 is configured to accept motors that can include their own casings. That is, the motor casing assembly 87 can act as an additional protective cover over the motor's original casing. This allows the motor casing body 89 to accept a variety of "off-the-shelf" motors for greater flexibility in terms of pump capacity and reparability. In addition, there will be greater flexibility in terms of providing the proper material composition for the motor casing assembly 87 with respect to, e.g., the fluid being pumped if the motor has its own casing. For example, the motor casing assembly 87 can be made of a material to withstand a corrosive fluid while the motor is protected by a casing made of a different material. In some embodiments that have only one protruded portion 45, the motor casing body 89 may not include the gears 50, 70 and the gears 50, 70 can be mounted at the end of the motors 41, 61. In such embodiments, the recesses 53 of the protruded portion 45 can be sized to accept the motor casing bodies 89 such that the gears 50, 70 and land 55 are properly aligned between the land 55 and the cover plate.

Detailed description of the pump operation is provided next.

Figure 5:
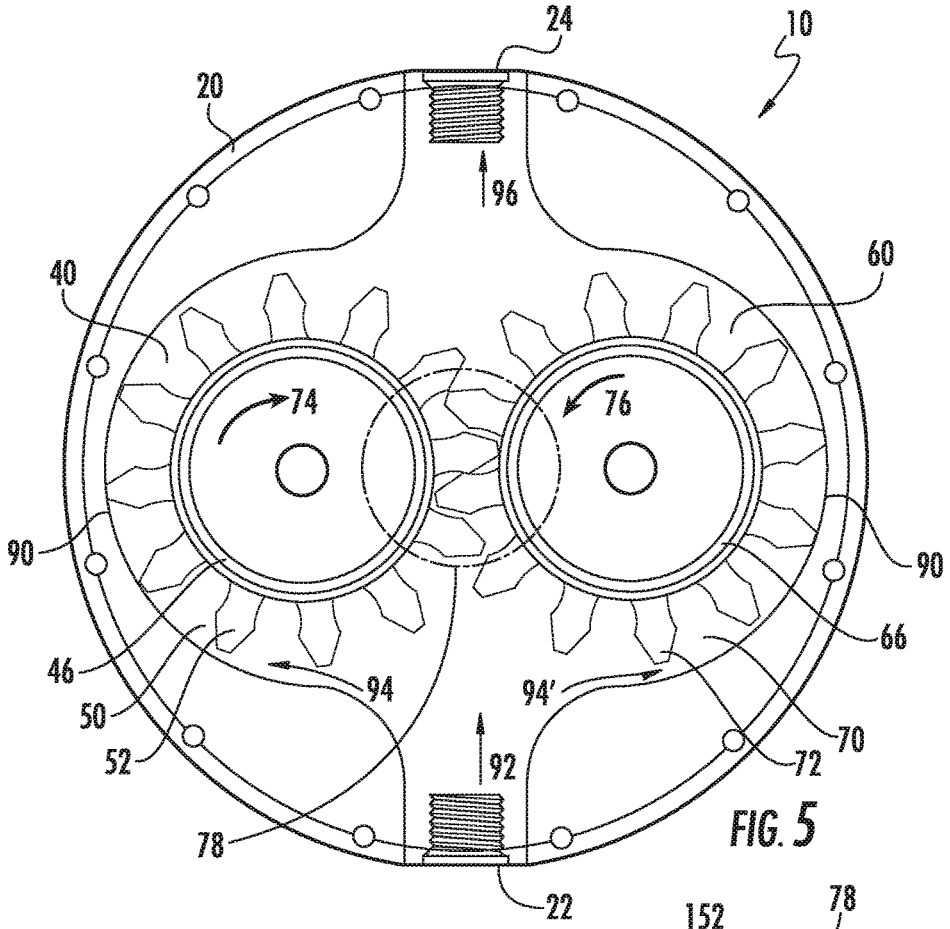
FIG. 5 illustrates exemplary flow paths of the fluid pumped by the external gear pump of FIG. 1.

FIG. 5 illustrates an exemplary fluid flow path of an exemplary embodiment of the external gear pump 10. The ports 22, 24, and a contact area 78 between the plurality of first gear teeth 52 and the plurality of second gear teeth 72 are substantially aligned along a single straight path. However, the alignment of the ports are not limited to this exemplary embodiment and other alignments are permissible. For explanatory purpose, the gear 50 is rotatably driven clockwise 74 by motor 41 and the gear 70 is rotatably driven counter-clockwise 76 by the motor 61. With this rotational configuration, port 22 is the inlet side of the gear pump 10 and port 24 is the outlet side of the gear pump 10. In some exemplary embodiments, both gears 50, 70 are respectively independently driven by the separately provided motors 41, 61.

As seen in FIG. 5, the fluid to be pumped is drawn into the casing 20 at port 22 as shown by an arrow 92 and exits the pump 10 via port 24 as shown by arrow 96. The pumping of the fluid is accomplished by the gear teeth 52, 72. As the gear teeth 52, 72 rotate, the gear teeth rotating out of the contact area 78 form expanding inter-tooth volumes between adjacent teeth on each gear. As these inter-tooth volumes expand, the spaces between adjacent teeth on each gear are filled with fluid from the inlet port, which is port 22 in this exemplary embodiment. The fluid is then forced to move with each gear along the interior wall 90 of the casing 20 as shown by arrows 94 and 94'. That is, the teeth 52 of gear 50 force the fluid to flow along the path 94 and the teeth 72 of gear 70 force the fluid to flow along the path 94'. Very small clearances between the tips of the gear teeth 52, 72 on each gear and the corresponding interior wall 90 of the casing 20 keep the fluid in the inter-tooth volumes trapped, which prevents the fluid from leaking back towards the inlet port. As the gear teeth 52, 72 rotate around and back into the contact area 78, shrinking inter-tooth volumes form between adjacent teeth on each gear because a corresponding tooth of the other gear enters the space between adjacent teeth. The shrinking inter-tooth volumes force the fluid to exit the space between the adjacent teeth and flow out of the pump 10 through port 24 as shown by arrow 96. In some embodiments, the motors 41, 61 are bi-directional and the rotation of motors 41, 61 can be reversed to reverse the direction fluid flow through the pump 10, i.e., the fluid flows from the port 24 to the port 22.

To prevent backflow, i.e., fluid leakage from the outlet side to the inlet side through the contact area 78, contact between a tooth of the first gear 50 and a tooth of the second gear 70 in the contact area 78 provides sealing against the backflow. The contact force is sufficiently large enough to provide substantial sealing but, unlike related art systems, the contact force is not so large as to significantly drive the other gear. In related art driver-driven systems, the force applied by the driver gear turns the driven gear, i.e., the driver gear meshes with (or interlocks with) the driven gear to mechanically drive the driven gear. While the force from the driver gear provides sealing at the interface point between the two teeth, this force is much higher than that necessary for sealing because this force must be sufficient enough to mechanically drive the driven gear to transfer the fluid at the desired flow and pressure. This large force causes material to shear off from the teeth in related art pumps. These sheared materials can be dispersed in the fluid, travel through the hydraulic system, and damage crucial operative components, such as O-rings and bearings. As a result, a whole pump system can fail and could interrupt operation of the pump. This failure and interruption of the operation of the pump can lead to significant downtime to repair the pump.

In exemplary embodiments of the pump 10, however, the gears 50, 70 of the pump 10 do not mechanically drive the other gear to any significant degree when the teeth 52, 72 form a seal in the contact area 78. Instead, the gears 50, 70 are rotatably driven independently such that the gear teeth 52, 72 do not grind against each other. That is, the gears 50, 70 are synchronously driven to provide contact but not to grind against each other. Specifically, rotation of the gears 50, 70 are synchronized at suitable rotation rates so that a tooth of the gear 50 contacts a tooth of the second gear 70 in the contact area 78 with sufficient enough force to provide substantial sealing, i.e., fluid leakage from the outlet port side to the inlet port side through the contact area 78 is substantially eliminated. However, unlike the driver-driven configurations discussed above, the contact force between the two gears is insufficient to have one gear mechanically drive the other to any significant degree. Precision control of the motors 41, 61, will ensure that the gear positions remain synchronized with respect to each other during operation. Thus, the above-described issues caused by sheared materials in conventional gear pumps are effectively avoided.

In some embodiments, rotation of the gears 50, 70 is at least 99% synchronized, where 100% synchronized means that both gears 50, 70 are rotated at the same rpm. However, the synchronization percentage can be varied as long as substantial sealing is provided via the contact between the gear teeth of the two gears 50, 70. In exemplary embodiments, the synchronization rate can be in a range of 95.0% to 100% based on a clearance relationship between the gear teeth 52 and the gear teeth 72. In other exemplary embodiments, the synchronization rate is in a range of 99.0% to 100% based on a clearance relationship between the gear teeth 52 and the gear teeth 72, and in still other exemplary embodiments, the synchronization rate is in a range of 99.5% to 100% based on a clearance relationship between the gear teeth 52 and the gear teeth 72. Again, precision control of the motors 41, 61, will ensure that the gear positions remain synchronized with respect to each other during operation. By appropriately synchronizing the gears 50, 70, the gear teeth 52, 72 can provide substantial sealing, e.g., a backflow or leakage rate with a slip coefficient in a range of 5% or less. For example, for typical hydraulic fluid at about 120 deg. F., the slip coefficient can be 5% or less for pump pressures in a range of 3000 psi to 5000 psi, 3% or less for pump pressures in a range of 2000 psi to 3000 psi, 2% or less for pump pressures in a range of 1000 psi to 2000 psi, and 1% or less for pump pressures in a range up to 1000 psi. In some exemplary embodiments, the gears 50, 70 are synchronized by appropriately synchronizing the motors 41, 61. Synchronization of multiple motors is known in the relevant art, thus detailed explanation is omitted here.

Figure 5A:
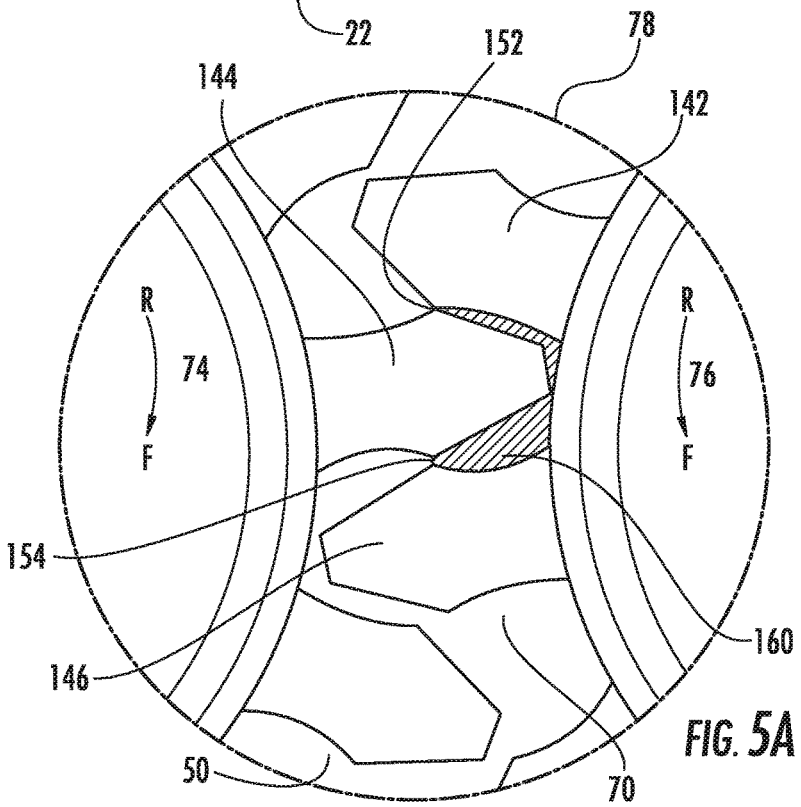
FIG. 5A shows a top cross-sectional view illustrating one-sided contact between two gears in a contact area in the external gear pump of FIG. 5.

In an exemplary embodiment, the synchronizing of the gears 50, 70 provides one-sided contact between a tooth of the gear 50 and a tooth of the gear 70. FIG. 5A shows a cross-sectional view illustrating this one-sided contact between the two gears 50, 70 in the contact area 78. For illustrative purposes, gear 50 is rotatably driven clockwise 74 and the gear 70 is rotatably driven counter-clockwise 76 independently of the gear 50. Further, the gear 70 is rotatably driven faster than the gear 50 by a fraction of a second, 0.01 sec/revolution, for example. This rotational speed difference between the gear 50 and gear 70 enables one-sided contact between the two gears 50, 70, which provides substantial sealing between gear teeth of the two gears 50, 70 to seal between the inlet port and the outlet port, as described above. Thus, as shown in FIG. 5A, a tooth 142 on the gear 70 contacts a tooth 144 on the gear 50 at a point of contact 152. If a face of a gear tooth that is facing forward in the rotational direction 74, 76 is defined as a front side (F), the front side (F) of the tooth 142 contacts the rear side (R) of the tooth 144 at the point of contact 152. However, the gear tooth dimensions are such that the front side (F) of the tooth 144 is not in contact with (i.e., spaced apart from) the rear side (R) of tooth 146, which is a tooth adjacent to the tooth 142 on the gear 70. Thus, the gear teeth 52, 72 are designed such that there is one-sided contact in the contact area 78 as the gears 50, 70 are driven. As the tooth 142 and the tooth 144 move away from the contact area 78 as the gears 50, 70 rotate, the one-sided contact formed between the teeth 142 and 144 phases out. As long as there is a rotational speed difference between the two gears 50, 70, this one-sided contact is formed intermittently between a tooth on the gear 50 and a tooth on the gear 70. However, because as the gears 50, 70 rotate, the next two following teeth on the respective gears form the next one-sided contact such that there is always contact and the backflow path in the contact area 78 remains substantially sealed. That is, the one-sided contact provides sealing between the ports 22 and 24 such that fluid carried from the pump inlet to the pump outlet is prevented (or substantially prevented) from flowing back to the pump inlet through the contact area 78.

In FIG. 5A, the one-sided contact between the tooth 142 and the tooth 144 is shown as being at a particular point, i.e. point of contact 152. However, a one-sided contact between gear teeth in the exemplary embodiments is not limited to contact at a particular point. For example, the one-sided contact can occur at a plurality of points or along a contact line between the tooth 142 and the tooth 144. For another example, one-sided contact can occur between surface areas of the two gear teeth. Thus, a sealing area can be formed when an area on the surface of the tooth 142 is in contact with an area on the surface of the tooth 144 during the one-sided contact. The gear teeth 52, 72 of each gear 50, 70 can be configured to have a tooth profile (or curvature) to achieve one-sided contact between the two gear teeth. In this way, one-sided contact in the present disclosure can occur at a point or points, along a line, or over surface areas. Accordingly, the point of contact 152 discussed above can be provided as part of a location (or locations) of contact, and not limited to a single point of contact.

In some exemplary embodiments, the teeth of the respective gears 50, 70 are designed so as to not trap excessive fluid pressure between the teeth in the contact area 78. As illustrated in FIG. 5A, fluid 160 can be trapped between the teeth 142, 144, 146. While the trapped fluid 160 provides a sealing effect between the pump inlet and the pump outlet, excessive pressure can accumulate as the gears 50, 70 rotate. In a preferred embodiment, the gear teeth profile is such that a small clearance (or gap) 154 is provided between the gear teeth 144, 146 to release pressurized fluid. Such a design retains the sealing effect while ensuring that excessive pressure is not built up. Of course, the point, line or area of contact is not limited to the side of one tooth face contacting the side of another tooth face. Depending on the type of fluid displacement member, the synchronized contact can be between any surface of at least one projection (e.g., bump, extension, bulge, protrusion, other similar structure or combinations thereof) on the first fluid displacement member and any surface of at least one projection (e.g., bump, extension, bulge, protrusion, other similar structure or combinations thereof) or an indent (e.g., cavity, depression, void or similar structure) on the second fluid displacement member. In some embodiments, at least one of the fluid displacement members can be made of or include a resilient material, e.g., rubber, an elastomeric material, or another resilient material, so that the contact force provides a more positive sealing area.

In the above discussed exemplary embodiments, both fluid drivers 40, 60, including electric motors 41, 61 and gears 50, 70, are integrated into a single pump casing 20. This novel configuration of the external gear pump 10 of the present disclosure enables a compact design that provides various advantages. First, the space or footprint occupied by the gear pump embodiments discussed above is significantly reduced by integrating necessary components into a single pump casing, when compared to conventional gear pumps. In addition, the total weight of a pump system is also reduced by removing unnecessary parts such as a shaft that connects a motor to a pump, and separate mountings for a motor/gear driver. Further, since the pump 10 of the present disclosure has a compact and modular design, it can be easily installed, even at locations where conventional gear pumps could not be installed, and can be easily replaced.

In addition, the novel balancing plate configuration provides various additional advantages. First, design of a gear pump is simplified. The need for a separately provided bearing block is eliminated by incorporating protruded portion 45 with recesses 53 into the pump design. Seal(s) and/or O-ring(s) disposed between each bearing block and the corresponding cover can be eliminated as well. As a lower number of seals and/or O-rings is employed in a gear pump, the probability of leakage in case of failure of these seals and/or O-rings is reduced. Further, the stiffness of each end plate 80, 82 is increased because the protruded portions 45 are part of or integrally attached to the respective balancing plate 80, 82, thus the pump 10 is less vulnerable to loads, e.g. bending loads, imposed during a pumping operation and structural stability (or structural durability) of the pump 10 is improved.

Figure 6:
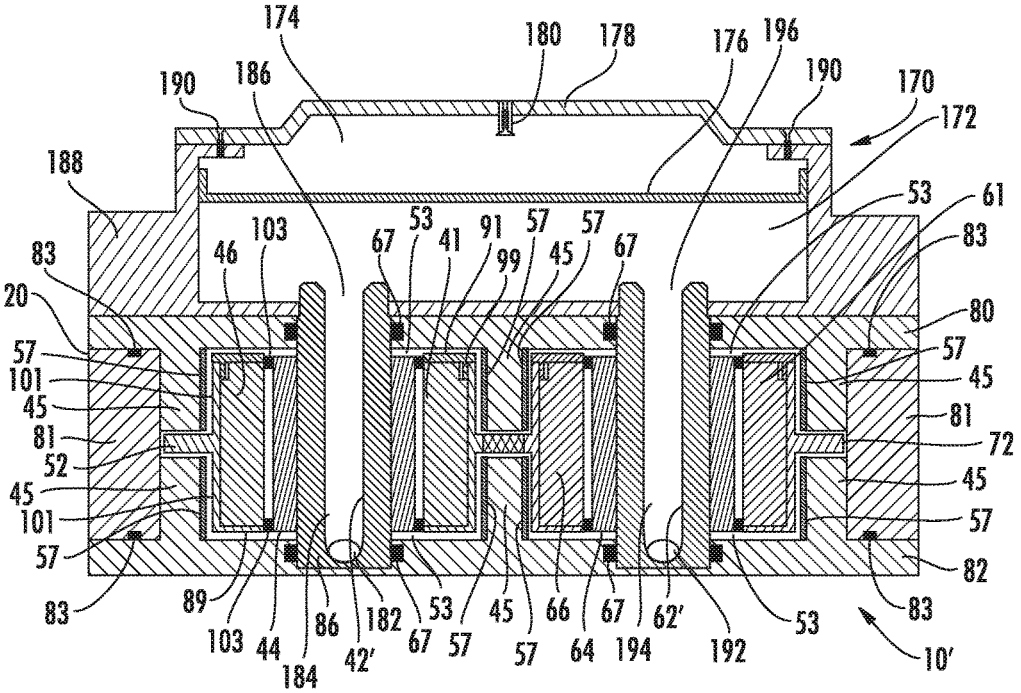
FIGS. 6 and 6A show cross-sectional views of a preferred embodiment of an external gear pump with a storage device.

In some exemplary embodiments of the present disclosure, the pump includes a fluid storage device that is fixedly attached to the pump so as to form one integrated unit. For example, FIG. 6 shows a side cross-sectional view of an exemplary embodiment of a fluid delivery system having a pump 10' and a storage device 170. As seen in FIG. 6, the arrangement of pump 10' is similar to that of pump 10, except that flow-through type shafts 42', 62' with respective through-passages 184 and 194 are included instead of shafts 42, 62. Accordingly, for brevity, a detailed description of pump 10' is omitted except as necessary to describe the present embodiment. In the embodiment of FIG. 6, each of the shafts 42', 62' are flow-through type shafts with each shaft having a through-passage that runs axially through the body of the shafts 42', 62'. One end of each shaft connects with an opening in the balancing plate 82 of a channel that connects to one of the ports 22, 24. For example, FIG. 6A, which is a side cross-sectional view, illustrates a channel 182 that extends through the balancing plate 82. One opening of channel 182 accepts one end of the flow-through shaft 42' while the other end of channel 182 opens to port 22 of the pump 10'. The other end of each flow-through shaft 42', 62' extends into the fluid chamber 172 via a respective opening in the balancing plate 80. Similar to pump 10, the flow-through shafts 42', 62', are fixedly connected to the respective openings in the casing 20. For example, the flow-through shafts 42', 62' can be attached to the channel openings (e.g., the openings for channels 182 and 192) in the balancing plate 80 and openings in the balancing plate 82 for connection to the storage device 170. The flow-through shafts 42', 62' can be attached by threaded fittings, press fit, interference fit, soldering, welding, any appropriate combination thereof or by other known means.

Figure 6A:
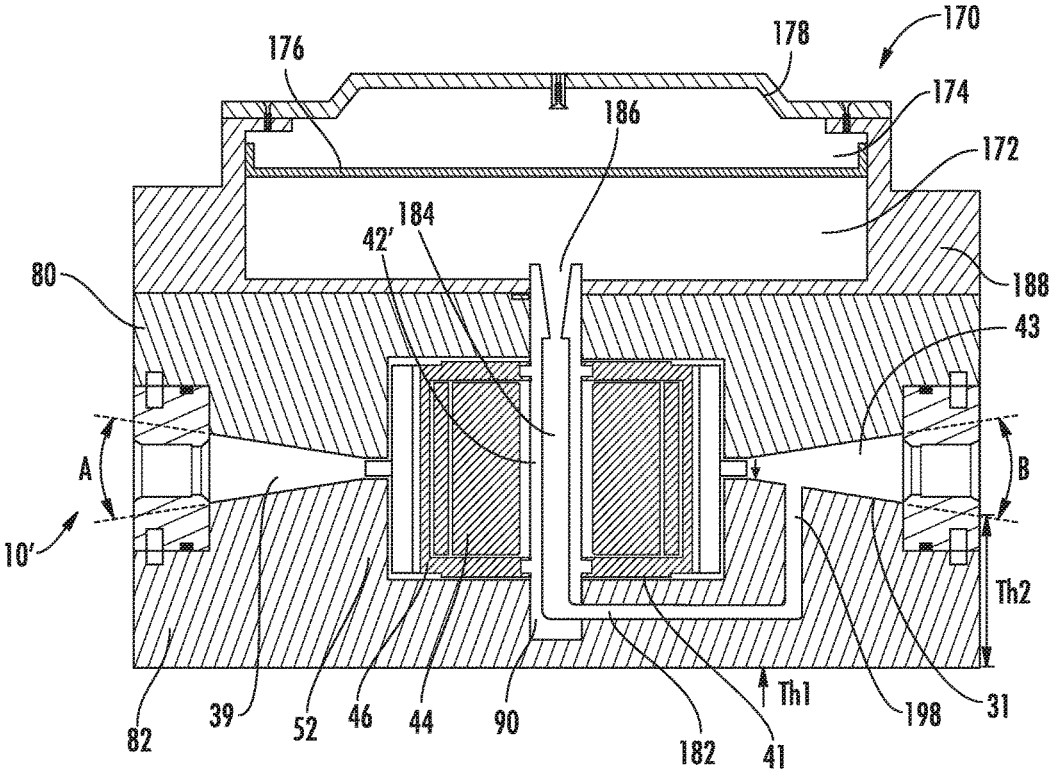

As shown in FIGS. 6 and 6A, the storage device 170 can be mounted to the pump 10', e.g., on the balancing plate 80 to form one integrated unit. The storage device 170 can store fluid to be pumped by the pump 10' and supply fluid needed to perform a commanded operation. In some embodiments, the storage device 170 in the pump 10' is a pressurized vessel that stores the fluid for the system. In such embodiments, the storage device 170 is pressurized to a specified pressure that is appropriate for the system. As shown in FIG. 6, the storage device 170 includes a vessel housing 188, a fluid chamber 172, a gas chamber 174, a separating element (or piston) 176, and a cover 178. The gas chamber 174 is separated from the fluid chamber 172 by the separating element 176. One or more sealing elements (not shown) may be provided along with the separating element 176 to prevent a leak between the two chambers 172, 174. At the center of the cover 178, a charging port 180 is provided such that the storage device 170 can be pressurized with a gas by way of charging the gas, nitrogen for example, through the charging port 180. Of course, the charging port 180 may be located at any appropriate location on the storage device 170. The cover 178 may be attached to the vessel housing 188 via a plurality of bolts 190 or other suitable means. One or more seals (not shown) may be provided between the cover 178 and the vessel housing 188 to prevent leakage of the gas.

In an exemplary embodiment, as shown in FIG. 6, the flow-through shaft 42' of fluid driver 40 penetrates through an opening in the balancing plate 80 and into the fluid chamber 172 of the pressurized vessel. The flow-through shaft 42' includes through-passage 184 that extends through the interior of shaft 42'. The through-passage 184 has a port 186 at an end of the flow-through shaft 42' that leads to the fluid chamber 172 such that the through-passage 184 is in fluid communication with the fluid chamber 172. At the other end of flow-through shaft 42', the through-passage 184 connects to a fluid passage 182 that extends through the balancing plate 82 and connects to either port 22 or 24 (connection to port 22 is shown in FIG. 6A) such that the through-passage 184 is in fluid communication with either the port 22 or the port 24. In this way, the fluid chamber 172 is in fluid communication with a port of pump 10'.

In some embodiments, a second shaft can also include a through-passage that provides fluid communication between a port of the pump and a fluid storage device. For example, the flow-through shaft 62' also penetrates through an opening in the end plate 80 and into the fluid chamber 172 of the storage device 170. The flow-through shaft 62' includes a through-passage 194 that extends through the interior of shaft 62'. The through-passage 194 has a port 196 at an end of flow-through shaft 62 that leads to the fluid chamber 172 such that the through-passage 194 is in fluid communication with the fluid chamber 172. At the other end of flow-through shaft 62, the through-passage 194 connects to a fluid channel 192 that extends through the end plate 82 and connects to either port 22 or 24 (not shown) such that the through-passage 194 is in fluid communication with a port of the pump 10'. In this way, the fluid chamber 172 is in fluid communication with a port of the pump 10'.

In the exemplary embodiment shown in FIG. 6, the through-passage 184 and the through-passage 194 share a common storage device 170. That is, fluid is provided to or withdrawn from the common storage device 170 via the through-passages 184, 194. In some embodiments, the through-passages 184 and 194 connect to the same port of the pump, e.g., either to port 22 or port 24. In these embodiments, the storage device 170 is configured to maintain a desired pressure at the appropriate port of the pump 10' in, for example, closed-loop fluid systems. In other embodiments, the passages 184 and 194 connect to opposite ports of the pump 10'. This arrangement can be advantageous in systems where the pump 10' is bi-directional. Appropriate valves (not shown) can be installed in either type of arrangement to prevent adverse operations of the pump 10'. For example, the valves (not shown) can be appropriately operated to prevent a short-circuit between the inlet and outlet of the pump 10' via the storage device 170 in configurations where the through-passages 184 and 194 go to different ports of the pump 10'.

In an exemplary embodiment, the storage device 170 may be pre-charged to a commanded pressure with a gas, e.g., nitrogen or some other suitable gas, in the gas chamber 174 via the charging port 180. For example, the storage device 170 may be pre-charged to at least 75% of the minimum required pressure of the fluid system and, in some embodiments, to at least 85% of the minimum required pressure of the fluid system. However, in other embodiments, the pressure of the storage device 170 can be varied based on operational requirements of the fluid system. The amount of fluid stored in the storage device 170 can vary depending on the requirements of the fluid system in which the pump 10 operates. For example, if the system includes an actuator, such as, e.g., a hydraulic cylinder, the storage vessel 170 can hold an amount of fluid that is needed to fully actuate the actuator plus a minimum required capacity for the storage device 170. The amount of fluid stored can also depend on changes in fluid volume due to changes in temperature of the fluid during operation and due to the environment in which the fluid delivery system will operate.

As the storage device 170 is pressurized, via, e.g., the charging port 180 on the cover 178, the pressure exerted on the separating element 176 presses against any liquid in the fluid chamber 172. As a result, the pressurized fluid is pushed through the through-passages 184 and 194 and then through the channels in the end plate 82 (e.g., channel 192 for through-passage 194) into a port of the pump 10' (or ports—depending on the arrangement) until the pressure in the storage device 170 is in equilibrium with the pressure at the port (ports) of the pump 10'. During operation, if the pressure at the relevant port drops below the pressure in the fluid chamber 172, the pressurized fluid from the storage device 170 is pushed to the appropriate port until the pressures equalize. Conversely, if the pressure at the relevant port goes higher than the pressure of fluid chamber 172, the fluid from the port is pushed to the fluid chamber 172 via through-passages 184 and 194.

Figure 7:
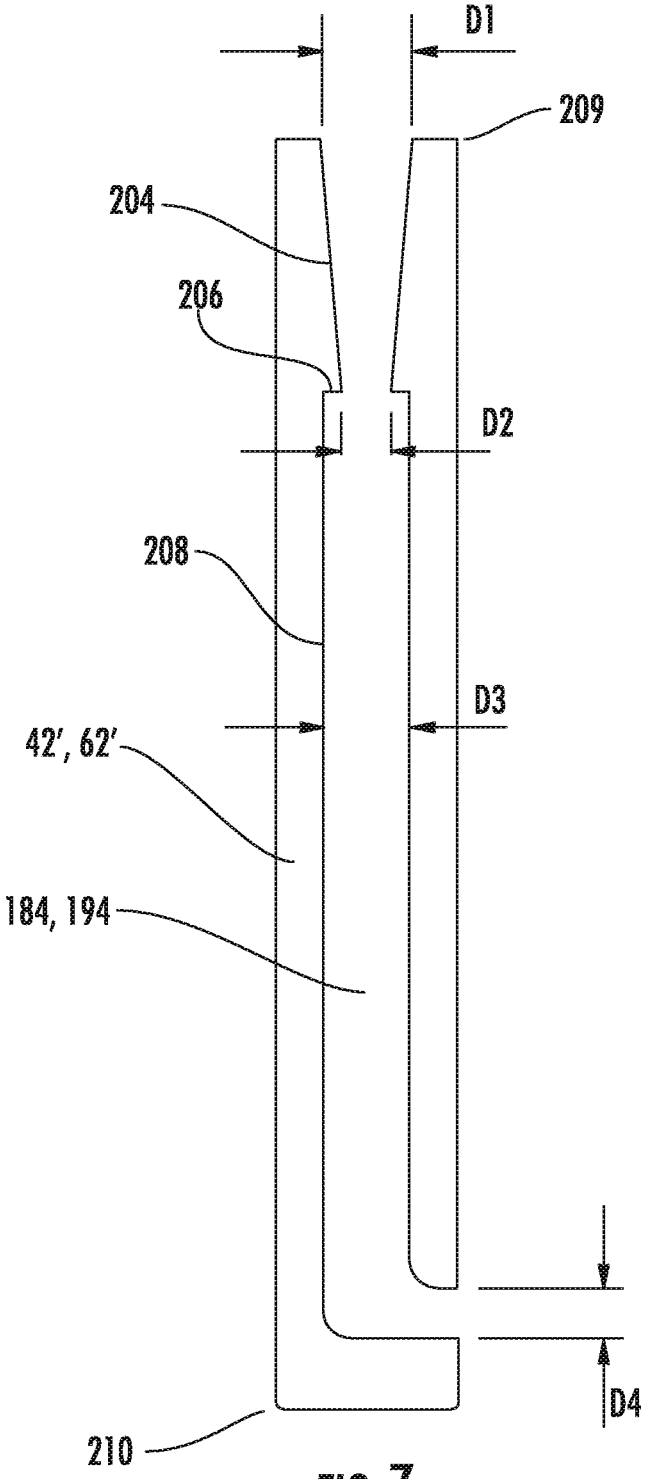
FIG. 7 shows a cross-sectional view of an exemplary embodiment of a flow-through shaft that can be used in the pump of FIG. 6.

FIG. 7 shows an enlarged view of an exemplary embodiment of the flow-through shaft 42', 62'. The through-passage 184, 194 extends through the flow-through shaft 42', 62' from end 209 to end 210 and includes a tapered portion (or converging portion) 204 at the end 209 (or near the end 209) of the shaft 42', 62'. The end 209 is in fluid communication with the storage device 170. The tapered portion 204 starts at the end 209 (or near the end 209) of the flow-through shaft 42', 62', and extends part-way into the through-passage 184, 194 of the flow-through shaft 42', 62' to point 206. In some embodiments, the tapered portion can extend 5% to 50% the length of the through-passage 184, 194. Within the tapered portion 204, the diameter of the through-passage 184, 194, as measured on the inside of the shaft 42', 62', is reduced as the tapered portion extends to end 206 of the flow-through shaft 42, 62. As shown in FIG. 7, the tapered portion 204 has, at end 209, a diameter D1 that is reduced to a smaller diameter D2 at point 206 and the reduction in diameter is such that flow characteristics of the fluid are measurably affected. In some embodiments, the reduction in the diameter is linear. However, the reduction in the diameter of the through-passage 184, 194 need not be a linear profile and can follow a curved profile, a stepped profile, or some other desired profile. Thus, in the case where the pressurized fluid flows from the storage device 170 and to the port of the pump via the through-passage 184, 194, the fluid encounters a reduction in diameter (D1→D2), which provides a resistance to the fluid flow and slows down discharge of the pressurized fluid from the storage device 170 to the pump port. By slowing the discharge of the fluid from the storage device 170, the storage device 170 behaves isothermally or substantially isothermally. It is known in the art that near-isothermal expansion/compression of a pressurized vessel, i.e. limited variation in temperature of the fluid in the pressurized vessel, tends to improve the thermal stability and efficiency of the pressurized vessel in a fluid system. Thus, in this exemplary embodiment, as compared to some other exemplary embodiments, the tapered portion 204 facilitates a reduction in discharge speed of the pressurized fluid from the storage device 170, which provides for thermal stability and efficiency of the storage device 170.

As the pressurized fluid flows from the storage device 170 to a port of the pump 10, the fluid exits the tapered portion 204 at point 206 and enters an expansion portion (or throat portion) 208 where the diameter of the through-passage 184, 194 expands from the diameter D2 to a diameter D3, which is larger than D2, as measured to manufacturing tolerances. In the embodiment of FIG. 7, there is step-wise expansion from D2 to D3. However, the expansion profile does not have to be performed as a step and other profiles are possible so long as the expansion is done relatively quickly. However, in some embodiments, depending on factors such the fluid being pumped and the length of the through-passage 184, 194, the diameter of the expansion portion 208 at point 206 can initially be equal to diameter D2, as measured to manufacturing tolerances, and then gradually expand to diameter D3. The expansion portion 208 of the through-passage 184, 194 serves to stabilize the flow of the fluid from the storage device 170. Flow stabilization may be needed because the reduction in diameter in the tapered portion 204 can induce an increase in speed of the fluid due to nozzle effect (or Venturi effect), which can generate a disturbance in the fluid. However, in the exemplary embodiments of the present disclosure, as soon as the fluid leaves the tapered portion 204, the turbulence in the fluid due to the nozzle effect is mitigated by the expansion portion 208. In some embodiments, the third diameter D3 is equal to the first diameter D1, as measured to manufacturing tolerances. In the exemplary embodiments of the present disclosure, the entire length of the flow-through shafts 42', 62' can be used to incorporate the configuration of through-passages 184, 194 to stabilize the fluid flow.

The stabilized flow exits the through passage 184, 194 at end 210. The through-passage 184, 194 at end 210 can be fluidly connected to either the port 22 or port 24 of the pump 10 via, e.g., channels in the end plate 82 (e.g., channel 182 for through-passage 184—see FIG. 6A). Of course, the flow path is not limited to channels within the pump casing and other means can be used. For example, the port 210 can be connected to external pipes and/or hoses that connect to port 22 or port 24 of pump 10'. In some embodiments, the through-passage 184, 194 at end 210 has a diameter D4 that is smaller than the third diameter D3 of the expansion portion 208. For example, the diameter D4 can be equal to the diameter D2, as measured to manufacturing tolerances. In some embodiments, the diameter D1 is larger than the diameter D2 by 50 to 75% and larger than diameter D4 by 50 to 75%. In some embodiments, the diameter D3 is larger than the diameter D2 by 50 to 75% and larger than diameter D4 by 50 to 75%.

The cross-sectional shape of the fluid passage is not limiting. For example, a circular-shaped passage, a rectangular-shaped passage, or some other desired shaped passage may be used. Of course, the through-passage in not limited to a configuration having a tapered portion and an expansion portion and other configurations, including through-passages having a uniform cross-sectional area along the length of the through-passage, can be used. Thus, configuration of the through-passage of the flow-through shaft can vary without departing from the scope of the present disclosure.

In the above embodiments, the flow-through shafts 42', 62' penetrate a short distance into the fluid chamber 172. However, in other embodiments, either or both of the flow-through shafts 42', 62' can be disposed such that the ends are flush with a wall of the fluid chamber 172. In some embodiments, the end of the flow-through shaft can terminate at another location such as, e.g., in the balancing plate 80, and suitable means such, e.g., channels, hoses, or pipes can be used so that the shaft is in fluid communication with the fluid chamber 172. In this case, the flow-through shafts 42', 62' may be disposed completely between the balancing plates 80, 82 without penetrating into the fluid chamber 172.

In the above embodiments, the storage device 170 is mounted on the balancing plate 80 of the casing 20. However, in other embodiments, the storage device 170 can be mounted on the balancing plate 82 of the casing 20. In still other embodiments, the storage device 170 may be disposed spaced apart from the pump 10'. In this case, the storage device 170 may be in fluid communication with the pump 10' via a connecting medium, for example hoses, tubes, pipes, or other similar devices.

Figure 8:
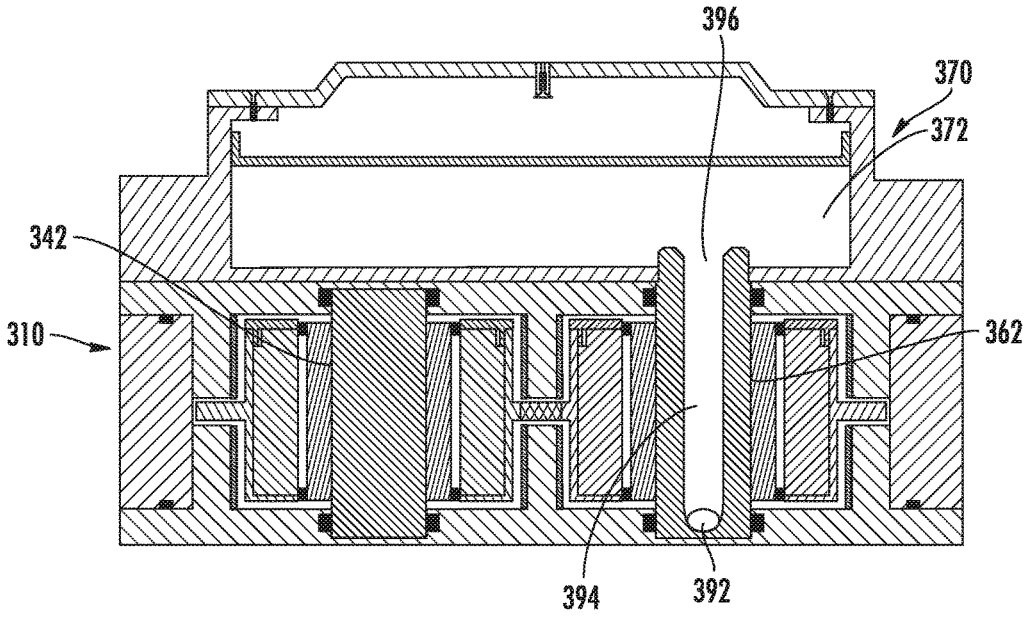
FIG. 8 shows cross-sectional view of a preferred embodiment of an external gear pump with a storage device.

In the above exemplary embodiments, both shafts 42', 62' include a through-passage configuration. However, in some exemplary embodiments, only one of the shafts has a through-passage configuration. For example, FIG. 8 shows a side cross-sectional view of another embodiment of an external gear pump and storage device system. In this embodiment, pump 310 is substantially similar to the exemplary embodiment of the external gear pump 10 and 10' discussed above. That is, the operation and function of fluid driver 340 are similar to that of fluid driver 40 and the operation and function of fluid driver 360 are similar to that fluid driver 60. Further, the configuration and function of storage device 370 is similar to that of storage device 170 discussed above. Accordingly, for brevity, a detailed description of the operation of pump 310 and storage device 370 is omitted except as necessary to describe the present exemplary embodiment. As shown in FIG. 8, unlike shaft 42' of pump 10', the shaft 342 of fluid driver 540 does not include a through-passage and can be, e.g., a solid shaft as shown or similar to shaft 42 discussed above. Thus, only shaft 362 of fluid driver 360 includes a through-passage 394. The through-passage 394 permits fluid communication between fluid chamber 372 and a port of the pump 310 via a channel 392. Those skilled in the art will recognize that through-passage 394 and channel 392 perform similar functions as through-passage 194 and channel 192 discussed above. Accordingly, for brevity, a detailed description of through-passage 394 and channel 392 and their function within pump 310 are omitted.

While the above exemplary embodiments illustrate only one storage device, exemplary embodiments of the present disclosure are not limited to one storage device and can have more than one storage device. For example, in an exemplary embodiment shown in FIG. 9, a storage device 770 can be mounted to the pump 710, e.g., on the balancing plate 782. The storage device 770 can store fluid to be pumped by the pump 710 and supply fluid needed to perform a commanded operation. In addition, another storage device 870 can also be mounted on the pump 710, e.g., on the balancing plate 780. Those skilled in the art would understand that the storage devices 770 and 870 are similar in configuration and function to storage device 170. Thus, for brevity, a detailed description of storage devices 770 and 870 is omitted, except as necessary to explain the present exemplary embodiment.

Figure 9:
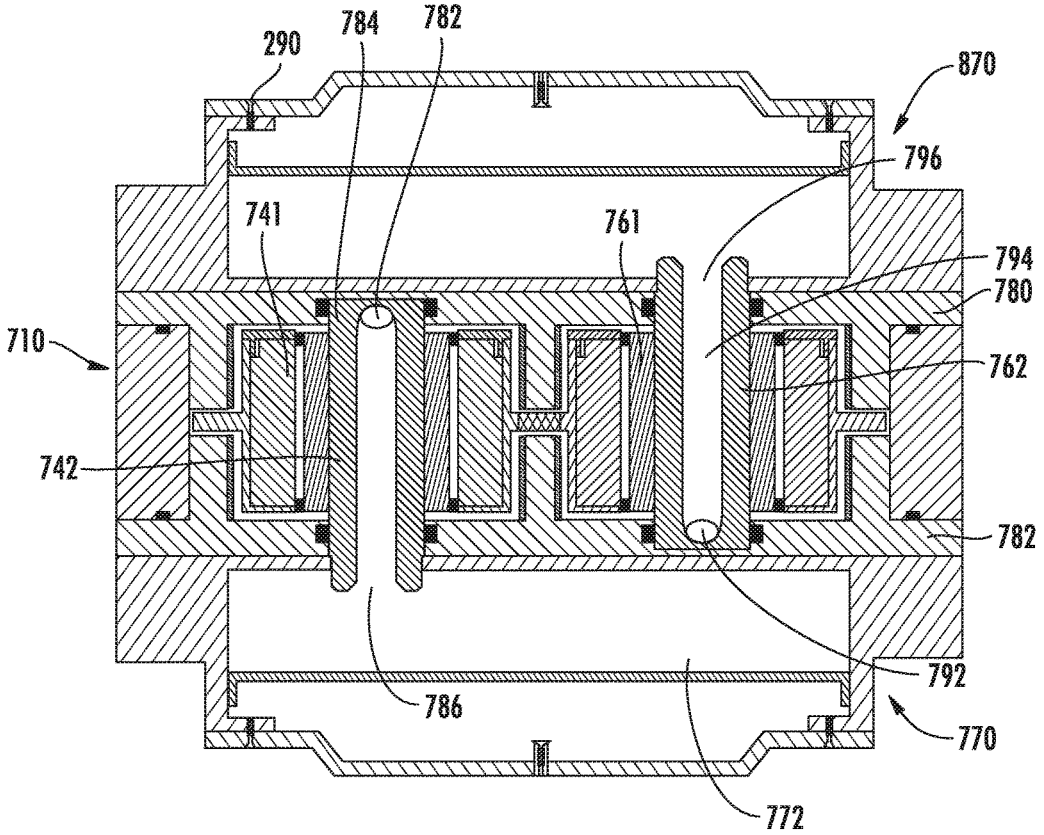
FIG. 9 shows cross-sectional view of a preferred embodiment of an external gear pump with two storage devices.

As seen in FIG. 9, motor 741 includes shaft 742. The shaft 742 includes a through-passage 784. The through-passage 784 has a port 786 which is disposed in the fluid chamber 772 such that the through-passage 784 is in fluid communication with the fluid chamber 772. The other end of through-passage 784 is in fluid communication with a port of the pump 710 via a channel 782. Those skilled in the art will understand that through-passage 784 and channel 782 are similar in configuration and function to through-passage 184 and channel 182 discussed above. Accordingly, for brevity, detailed description of through-passage 784 and its characteristics and function within pump 710 are omitted.

The pump 710 also includes a motor 761 that includes shaft 762. The shaft 762 includes a through-passage 794. The through-passage 794 has a port 796 which is disposed in the fluid chamber 872 such that the through-passage 794 is in fluid communication with the fluid chamber 872. The other end of through-passage 794 is in fluid communication with a port of the pump 710 via a channel 792. Those skilled in the art will understand that through-passage 794 and channel 792 are similar to through-passage 194 and channel 192 discussed above. Accordingly, for brevity, detailed description of through-passage 794 and its characteristics and function within pump 710 are omitted.

The channels 782 and 792 can each be connected to the same port of the pump or to different ports. Connection to the same port can be beneficial in certain circumstances. For example, if one large storage device is impractical for any reason, it might be possible to split the storage capacity between two smaller storage devices that are mounted on opposite sides of the pump as illustrated in FIG. 9. Alternatively, connecting each storage device 770 and 870 to different ports of the pump 710 can also be beneficial in certain circumstances. For example, a dedicated storage device for each port can be beneficial in circumstances where the pump is bi-directional and in situations where the inlet of the pump and the outlet of the pump experience pressure spikes that need to be smoothened or some other flow or pressure disturbance that can be mitigated or eliminated with a storage device. Of course, each of the channels 782 and 792 can be connected to both ports of the pump 710 such that each of the storage devices 770 and 870 can be configured to communicate with a desired port using appropriate valves (not shown). In this case, the valves would need to be appropriately operated to prevent adverse pump operation.

In the exemplary embodiment shown in FIG. 9, the storage devices 770, 870 are fixedly mounted to the casing of the pump 710. However, in other embodiments, one or both of the storage devices 770, 870 may be disposed space apart from the pump 710. In this case, the storage device or storage devices can be in fluid communication with the pump 710 via a connecting medium, for example hoses, tubes, pipes, or other similar devices.

Although the above embodiments were described with respect to an external gear pump design with spur gears having gear teeth, it should be understood that those skilled in the art will readily recognize that the concepts, functions, and features described below can be readily adapted to external gear pumps with other gear designs (helical gears, herringbone gears, or other gear teeth designs that can be adapted to drive fluid), to pumps having more than two prime movers, to prime movers other than electric motors, e.g., hydraulic motors or other fluid-driven motors or other similar devices that can drive a fluid displacement member, and to fluid displacement members other than an external gear with gear teeth, e.g., internal gear with gear teeth, a hub (e.g. a disk, cylinder, other similar component) with projections (e.g. bumps, extensions, bulges, protrusions, other similar structures or combinations thereof), a hub (e.g. a disk, cylinder, or other similar component) with indents (e.g., cavities, depressions, voids or other similar structures), a gear body with lobes, or other similar structures that can displace fluid when driven. Accordingly, for brevity, detailed description of the various pump designs are omitted. Further, while the above embodiments have fluid displacement members with an external gear design, those skilled in the art will recognize that, depending on the type of fluid displacement member, the synchronized contact is not limited to a side-face to side-face contact and can be between any surface of at least one projection (e.g. bump, extension, bulge, protrusion, other similar structure, or combinations thereof) on one fluid displacement member and any surface of at least one projection (e.g. bump, extension, bulge, protrusion, other similar structure, or combinations thereof) or indent (e.g., cavity, depression, void or other similar structure) on another fluid displacement member.

The fluid displacement members, e.g., gears in the above embodiments, can be made entirely of any one of a metallic material or a non-metallic material. Metallic material can include, but is not limited to, steel, stainless steel, anodized aluminum, aluminum, titanium, magnesium, brass, and their respective alloys. Non-metallic material can include, but is not limited to, ceramic, plastic, composite, carbon fiber, and nano-composite material. Metallic material can be used for a pump that requires robustness to endure high pressure, for example. However, for a pump to be used in a low pressure application, non-metallic material can be used. In some embodiments, the fluid displacement members can be made of a resilient material, e.g., rubber, elastomeric material, etc., to, for example, further enhance the sealing area.

Alternatively, the fluid displacement member, e.g., gears in the above embodiments, can be made of a combination of different materials. For example, the body can be made of aluminum and the portion that makes contact with another fluid displacement member, e.g., gear teeth in the above exemplary embodiments, can be made of steel for a pump that requires robustness to endure high pressure, a plastic for a pump for a low pressure application, a elastomeric material, or another appropriate material based on the type of application.

Exemplary pumps of the present disclosure can pump a variety of fluids. For example, the pumps can be designed to pump hydraulic fluid, engine oil, crude oil, blood, liquid medicine (syrup), paints, inks, resins, adhesives, molten thermoplastics, bitumen, pitch, molasses, molten chocolate, water, acetone, benzene, methanol, or another fluid. As seen by the type of fluid that can be pumped, exemplary embodiments of the pump can be used in a variety of applications such as heavy and industrial machines, chemical industry, food industry, medical industry, commercial applications, residential applications, or another industry that uses pumps. Factors such as viscosity of the fluid, desired pressures and flow for the application, the design of the fluid displacement member, the size and power of the motors, physical space considerations, weight of the pump, or other factors that affect pump design will play a role in the pump design. It is contemplated that, depending on the type of application, pumps consistent with the embodiments discussed above can have operating ranges that fall with a general range of, e.g., 1 to 5000 rpm. Of course, this range is not limiting and other ranges are possible.

The pump operating speed can be determined by taking into account factors such as viscosity of the fluid, the prime mover capacity (e.g., capacity of electric motor, hydraulic motor or other fluid-driven motor, internal-combustion, gas or other type of engine or other similar device that can drive a fluid displacement member), fluid displacement member dimensions (e.g., dimensions of the gear, hub with projections, hub with indents, or other similar structures that can displace fluid when driven), desired flow rate, desired operating pressure, and pump bearing load. In exemplary embodiments, for example, applications directed to typical industrial hydraulic system applications, the operating speed of the pump can be, e.g., in a range of 300 rpm to 900 rpm. In addition, the operating range can also be selected depending on the intended purpose of the pump. For example, in the above hydraulic pump example, a pump designed to operate within a range of 1-300 rpm can be selected as a stand-by pump that provides supplemental flow as needed in the hydraulic system. A pump designed to operate in a range of 300-600 rpm can be selected for continuous operation in the hydraulic system, while a pump designed to operate in a range of 600-900 rpm can be selected for peak flow operation. Of course, a single, general pump can be designed to provide all three types of operation.

The applications of the exemplary embodiments can include, but are not limited to, reach stackers, wheel loaders, forklifts, mining, aerial work platforms, waste handling, agriculture, truck crane, construction, forestry, and machine shop industry. For applications that are categorized as light size industries, exemplary embodiments of the pump discussed above can displace from 2 $cm^3$/rev (cubic centimeters per revolution) to 150 $cm^3$/rev with pressures in a range of 1500 psi to 3000 psi, for example. The fluid gap, i.e., tolerance between the gear teeth and the gear housing which defines the efficiency and slip coefficient, in these pumps can be in a range of +0.00-0.05 mm, for example. For applications that are categorized as medium size industries, exemplary embodiments of the pump discussed above can displace from 150 $cm^3$/rev to 300 $cm^3$/rev with pressures in a range of 3000 psi to 5000 psi and a fluid gap in a range of +0.00-0.07 mm, for example. For applications that are categorized as heavy size industries, exemplary embodiments of the pump discussed above can displace from 300 $cm^3$/rev to 600 $cm^3$/rev with pressures in a range of 3000 psi to 12,000 psi and a fluid gap in a range of +0.00-0.0125 mm, for example.

In addition, the dimensions of the fluid displacement members can vary depending on the application of the pump. For example, when gears are used as the fluid displacement members, the circular pitch of the gears can range from less than 1 mm (e.g., a nano-composite material of nylon) to a few meters wide in industrial applications. The thickness of the gears will depend on the desired pressures and flows for the application.

In some embodiments, the speed of the prime mover, e.g., a motor, that rotates the fluid displacement members, e.g., a pair of gears, can be varied to control the flow from the pump. In addition, in some embodiments the torque of the prime mover, e.g., motor, can be varied to control the output pressure of the pump.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A pump with self-aligning casing, comprising:

a casing defining an interior volume, the casing including, an inlet port that provides fluid communication with the interior volume, an outlet port that provides fluid communication with the interior volume, a first protruded portion extending toward the interior volume, the first protruded portion having a first land and first and second recesses, a second protruded portion extending toward the interior volume and opposing the first protruded portion, the second protruded portion having a second land and third and fourth recesses, the first and second protruded portions disposed such that the first land and the second land confront each other and are spaced apart to define a gap;

a first fluid driver, the first fluid driver including, a first support shaft supported by the casing, and a first motor casing housing a first stator and a first rotor and fixedly connected to the first rotor, which drives the first motor casing in a first rotational direction, the first motor casing at least partially disposed in the first recess and the third recess, and a first gear having a plurality of first gear teeth fixedly connected to and projecting radially outwardly from the first motor casing, the first gear teeth disposed in the gap; and a second fluid driver, the second fluid driver including, a second support shaft supported by the casing, and a second motor casing housing a second stator and a second rotor and fixedly connected to the second rotor, which independently drives the second motor casing in a second rotational direction, the second motor casing at least partially disposed in the second recess and the fourth recess, and a second gear having a plurality of second gear teeth fixedly connected to and projecting radially outwardly from the second motor casing, the second gear teeth disposed in the gap;

wherein the first and second protruded portions align the first and second fluid drivers such that the first gear teeth contact with the second gear teeth.

2. The pump of claim 1, wherein at least one of the first and second protruded portions is part of an end plate of the casing.

3. The pump of claim 1, the pump further comprising:

first bearings disposed between the first motor casing and each of the first and third recesses, and second bearings disposed between the second motor casing and each of the second and fourth recesses.

4. The pump of claim 1, wherein at least one of the first protruded portion and the second protruded portion includes at least one cooling groove respectively disposed on at least one of the first land and the second land.

5. The pump of claim 4, wherein the at least one cooling groove extends from at least one of the first recess to the second recess and the third recess to the fourth recess.

6. The pump of claim 1, wherein the first and second protruded portions each include a first sloped segment and the first sloped segments form a converging flow path in which a cross-sectional area of at least a portion of the converging flow path extending from the inlet port to the first and second gears is reduced, and wherein the first and second protruded portions each include a second sloped segment and the second sloped segments form a diverging flow path in which a cross-sectional area of at least a portion of the diverging flow path extending from the first and second gears to the outlet port is expanded.

7. A pump, comprising:

a casing defining an interior volume, the casing including, an inlet port that provides fluid communication with the interior volume, an outlet port that provides fluid communication with the interior volume, at least one protruded portion extending toward the interior volume, each of the at least one protruded portion having a land and first and second recesses, a first fluid driver, the first fluid driver including, a first support shaft supported by the casing, and a first motor casing housing a first stator and a first rotor and fixedly connected to the first rotor, which drives the first motor casing in a first rotational direction, the first motor casing at least partially disposed in one of the first recess and the second recess of the at least one protruded portion, and a first gear having a plurality of first gear teeth fixedly connected to and projecting radially outwardly from the first motor casing, the first gear teeth disposed in a gap defined at least in part by the at least one protruded portion; and a second fluid driver, the second fluid driver including, a second support shaft supported by the casing, and a second motor casing housing a second stator and a second rotor and fixedly connected to the second rotor, which independently drives the second motor casing in a second rotational direction, the second motor casing at least partially disposed in the other of the first recess and the second recess of the at least one protruded portion, a second gear having a plurality of second gear teeth fixedly connected to and projecting radially outwardly from the second motor casing, the second gear teeth disposed in the gap; and at least one cooling groove disposed on at least one of the land of the at least one protruded portion and an end plate of the casing.

8. The pump of claim 7, wherein the at least one cooling groove is disposed on each land of the at least one protruded portion and the at least one cooling groove extends from the first recess to the second recess of the at least one protruded portion.

9. The pump of claim 8, wherein the at least one protruded portion is a first protruded portion and a second protruded portion, and wherein the at least one cooling groove is disposed on the land of one of the first protruded portion and the second protruded portion.

10. The pump of claim 7, wherein the at least one cooling groove is disposed on the end plate of the casing.

11. A pump with self-aligning casing, comprising:

a casing defining an interior volume, the casing including, an inlet port that provides fluid communication with the interior volume, an outlet port that provides fluid communication with the interior volume, at least one protruded portion extending toward the interior volume, each of the at least one protruded portion having a land and first and second recesses, a first fluid driver, the first fluid driver including, a first support shaft supported by the casing, and a first motor casing housing a first stator and a first rotor and fixedly connected to the first rotor, which drives the first motor casing in a first rotational direction, the first motor casing at least partially disposed in one of the first recess and the second recess of the at least one protruded portion, and a first gear having a plurality of first gear teeth fixedly connected to and projecting radially outwardly from the first motor casing, the first gear teeth disposed in a gap defined at least in part by the at least one protruded portion; and a second fluid driver, the second fluid driver including, a second support shaft supported by the casing, and a second motor casing housing a second stator and a second rotor and fixedly connected to the second rotor, which independently drives the second motor casing in a second rotational direction, the second motor casing at least partially disposed in the other of the first recess and the second recess of the at least one protruded portion, a second gear having a plurality of second gear teeth fixedly connected to and projecting radially outwardly from the second motor casing, the second gear teeth disposed in the gap; and wherein the at least one protruded portion aligns the first and second fluid drivers such that the first gear teeth contact with the second gear teeth.

12. The pump of claim 11, wherein the at least one protruded portion is one protruded portion, and wherein the gap is defined by the one protruded portion and an end plate of the casing.

* * * * *